US008442246B2

(12) United States Patent
Morii et al.

(10) Patent No.: US 8,442,246 B2
(45) Date of Patent: May 14, 2013

(54) HEARING AID DEVICE AND HEARING AID METHOD

(75) Inventors: Keiko Morii, Kanagawa (JP); Takeo Kanamori, Osaka (JP); Koichiro Mizushima, Kanagawa (JP)

(73) Assignee: Panasonic Corporation, Osaka (JP)

( * ) Notice: Subject to any disclaimer, the term of this patent is extended or adjusted under 35 U.S.C. 154(b) by 22 days.

(21) Appl. No.: 13/266,658

(22) PCT Filed: Apr. 26, 2010

(86) PCT No.: PCT/JP2010/002996

§ 371 (c)(1),
(2), (4) Date: Oct. 27, 2011

(87) PCT Pub. No.: WO2010/125797

PCT Pub. Date: Nov. 4, 2010

(65) Prior Publication Data

US 2012/0057733 A1 Mar. 8, 2012

(30) Foreign Application Priority Data

Apr. 28, 2009 (JP) ..... 2009-108805

(51) Int. Cl.
*H04R 25/00* (2006.01)

(52) U.S. Cl.
USPC ..... 381/313; 381/312; 381/321

(58) Field of Classification Search ..... 381/312–313, 381/316–317, 320–321
See application file for complete search history.

(56) References Cited

U.S. PATENT DOCUMENTS

| | | | |
|---|---|---|---|
| 2005/0244018 | A1 | 11/2005 | Fischer et al. |
| 2006/0177079 | A1 | 8/2006 | Baekgaard Jensen et al. |
| 2008/0159568 | A1 | 7/2008 | Asada et al. |

FOREIGN PATENT DOCUMENTS

| | | |
|---|---|---|
| JP | 11-69494 | 3/1999 |
| JP | 2000-261894 | 9/2000 |
| JP | 2001-510975 | 8/2001 |
| JP | 2003-337164 | 11/2003 |
| JP | 2005-253079 | 9/2005 |
| JP | 2007-515830 | 6/2007 |
| JP | 2008-92193 | 4/2008 |
| JP | 2008-517497 | 5/2008 |
| JP | 2008-166897 | 7/2008 |
| WO | 99/04598 | 1/1999 |
| WO | 2006/042540 | 4/2006 |

OTHER PUBLICATIONS

International Search Report issued Jun. 1, 2010 in International (PCT) Application No. PCT/JP2010/002996.

(Continued)

*Primary Examiner* — Suhan Ni
(74) *Attorney, Agent, or Firm* — Wenderoth, Lind & Ponack, L.L.P.

(57) ABSTRACT

A hearing aid device includes a plurality of microphones which converts picked sound to audio signals, an inter-signal phase difference calculation unit which calculates a phase difference between a first audio signal and a second audio signal, a hand placement determination unit, a directivity sound pickup unit which generates an output signal, a non-linear amplification unit which controls the signal level of the output signal acquired from the directivity sound pickup unit, and a hearing aid process control unit which, when the hand placement determination unit determines that a state where a phase difference is equal to or smaller than a first threshold value continues for a first time, controls the directivity sound pickup unit such that at least one of the sensitivity-frequency characteristic and the frequency characteristics of the audio signals becomes nondirective, and controls the nonlinear amplification unit to amplify the signal levels of the acquired audio signals.

8 Claims, 10 Drawing Sheets

OTHER PUBLICATIONS

Yoshizumi et al., "*Silent Design and Sound Environment Adaption for Directional Digital Hearing Aids*", Matsushita Technical Journal; Jul. 2008; pp. 48-49; vol. 54, No. 2; Matsushita Electric Co., Ltd.; Japan.

Hamanaka et al.; "*Sound Scope Headphones*", Transactions of the Virtual Reality Society of Japan; 2007; pp. 295-304; vol. 12, No. 3; Virtual Reality Society of Japan; Japan.

James M. Kates; "*Digital Hearing Aids*"; May 30, 2008; pp. 75-111; Plural Publishing, Inc.; USA.

HEARING AID DEVICE AND HEARING AID METHOD

TECHNICAL FIELD

The present invention relates to a hearing aid device and a hearing aid method capable of detecting a users hand placement based on input signals from respective microphones.

BACKGROUND ART

A hearing aid is provided with several switches for volume control and the like, but a switch provided in the main body is very small, and in many cases, it is difficult to operate the switch in a state where the hearing aid is mounted in the canal. Accordingly, if a user can operate the hearing aid with a gesture (hereinafter, referred to as a hand placement) in which the user of the hearing aid places his/her hand over his/her ear, it becomes easy to operate the hearing aid.

Patent Document 1 describes a device which has a hand placement detection function capable of detecting a hand placement by a distance sensor. If a hand placement is detected, a sound source can be selected when hearing through a headphone.

FIG. 18 is a schematic configuration diagram showing a configuration 1600 which realizes a hand placement detection function described in Patent Document 1. In the configuration shown in FIG. 18, an infrared distance sensor 1611 measures a distance from a contiguous object. As shown in FIG. 18, when the distance δ between the palm 1612 of the users hand and the infrared distance sensor 1611 is within a given range, it is possible to detect the hand placement.

Patent Document 2 describes a device which detects a temporal change in a phase difference spectral pattern using the phase difference spectral pattern input from two microphones changing depending on the ambient situation, without using a distance sensor.

FIG. 19 is a block diagram showing the configuration of a device which detects a temporal change in a phase difference spectral pattern in Patent Document 2. In the arrangement shown in FIG. 19 a phase difference spectrum of two inputs is calculated from input signals from microphones 1901*a* and 1901*b* by frequency analysis means 1713*a* and 1713*b* and phase difference spectrum calculation means 1714 using fast Fourier transform. Temporal change detection means 1715 detects a time difference in the phase difference spectrum, and in-space change determination means 1716 detects a change in a space based on the detection result of the temporal change detection means 1715.

Patent Document 3 describes a headphone device which detects a users motion for tapping a device casing to perform a predetermined process. The headphone device has electro-acoustic conversion means for reproducing and outputting sound signals, and acousto-electric conversion means provided at a position where reproduced sound can be picked up. With regard to the output of the acousto-electric conversion means, removing means removes sound reproduced from the electro-acoustic conversion means, and determination means determines whether or not a predetermined motion is performed on the casing. When it is determined that a predetermined motion is performed on the casing, control means performs control such that a predetermined process is performed, thereby operating the device without using an operating button or the like.

RELATED ART DOCUMENTS

Patent Documents

Patent Document 1; JP-A-2008-92193
Patent Document 2: JP-A-2003-337164
Patent Document 3: JP-A-2008-166897

Non-Patent Documents

Non-Patent Document 1: "Silent Design and Sound Environment Adaptation for Directional Digital Hearing Aids", Matsushita Technical Journal, 54(2), pp. 48-49 (2008)
Non-Patent Document 2: "Sound Scope Headphones", The Virtual Reality Society of Japan, 12(3), pp. 295-pp. 304 (2008) (1.5-1.7 on the right side of pp. 295)

SUMMARY OF THE INVENTION

Problem to be Solved by the Invention

A hearing aid is provided with several switches. In recent years, for example, a hearing aid is known which has two or more microphones to realize a function of highlighting forward sound through a directivity signal process (for example, see Non-Patent Document 1). The hearing aid which has two or more microphones and performs a directivity signal processing according to forward sound is provided with a directivity mode switch, and a user switches the directivity mode switch depending on the ambient environment. A plurality of switches, such as a volume control switch, are attached to the hearing aid main body. However, since the volume of the device itself, such as the hearing aid, is small, each switch of the hearing aid main body is small, such that it is not easy for the user to operate the switches in a state where the hearing aid is mounted in the canal.

A motion for placing a hand over an ear is considered. When a hearing aid is not mounted, if a hand is placed over an ear, forward sound is highlighted by about 6 to 15 dB and easily heard. For this reason, when a person wants to hear forward sound better, the person naturally places his/her hand over his/her ear. This fact is described in Non-Patent Document 2 as "a natural motion when a person hears sound, such as a pose for holding his/her hand close to his/her ear and opening his/her ear".

Thus, when a user takes "a pose for holding his/her hand close to his/her ear and opening the ear", it is appropriate to analyze that the user wants to hear forward sound better. When the user takes "a pose for holding his/her hand close to his/her ear and opening his/her ear", in a hearing aid which performs the directivity signal process using two or more microphones, the directivity signal process does not function as intended due to the presence of the palm of the hand, and a result as the user intended is not necessarily obtained.

Accordingly, in the hearing aid, it is necessary to detect a hand placement over an ear by any means. However, in the related art configuration shown in FIG. 18, it is necessary to provide a new sensor for detecting a hand placement over an ear. In the case of a device, such as a hearing aid, if an additional sensor is provided, the size of the device increases, and the fitting is not satisfactory. The addition of a new sensor leads to new cost.

In the related art configuration shown in FIG. 18, since a change in a space is detected based on a temporal change in a phase difference spectral pattern, it is necessary to determine a phase difference spectral pattern at a point of time as a reference in advance. In a hearing aid in which a phase difference spectrum varies depending on the head spinning or movement of a person who is fitted with the hearing aid, there is a problem in that it is difficult to determine a phase difference spectral pattern as a reference in advance.

If the related art configuration shown in Patent Document 3 is applied to a hearing aid, sound generated when the user taps the casing is input to a microphone provided in the hearing aid, Unlike a headphone stereo described in Patent Document 3, in the case of a hearing aid, sound input to the microphone is amplified and heard by the user, For this reason, there is a problem in that unpleasant sound generated when the user taps the casing is reproduced loudly as abnormal noise for the user, It is not easy for the user to perform a motion for tapping the small casing of the hearing aid, and there is also a problem in that the users motion and the desired effect are not intuitively linked together.

In order to solve the problem in the related art, it is necessary that a hand placement over an ear is detected by any means without providing an additional sensor, and that control automatically changes such that forward sound is more easily heard in the hand placement state. That is, it is necessary that a hand placement, that is, a motion regarding "the pose for holding the hand close to the ear and opening the ear", which is easy for the user, unlikely to generate abnormal noise of the hearing aid, and is considered to mean the user of the hearing aid wants to hear forward sound, is detected without providing an additional sensor, and automatic control of the hearing aid is performed based on the detection of the hand placement such that forward sound is easily heard.

In a directivity signal process of a hearing aid having two or more microphones, typically, an input from a microphone on the other side is temporally delayed with respect to an input of a microphone in front in the hearing aid, and a subtraction process is performed, thereby realizing forward directivity (for example, see Non-Patent Document 1).

That is, on the assumption that there is a difference in the sound incoming time between two or more microphones, that is, there is a phase difference, when the phase difference departs from an appropriate range, in a directivity signal process intended for a typical use, adequate forward directivity is not obtained.

Accordingly, if "a case where a phase difference departs from an appropriate range" can be detected, it becomes possible to detect a case where a directivity signal process does not function as intended, such as placing a hand over an ear, or the like.

An object of the invention is to provide a hearing aid device and a hearing aid method capable of controlling a directivity process or an amplification process in a hearing aid with a user's hand placement so as to match a user's intuition.

Means for Solving the Problem

The present invention provides a hearing aid device including: a plurality of microphones configured to convert picked sound to audio signals; an inter-signal phase difference calculation unit configured to calculate a phase difference between a first audio signal converted by a first microphone of the plurality of microphones and a second audio signal by a second microphone of the plurality of microphones; a hand placement determination unit configured to determine whether a state where the phase difference is a first threshold value or less continues for a first time; a directivity sound pickup unit configured to superimpose a sensitivity-frequency characteristic for controlling sensitivity in a sound pickup direction on the first audio signal acquired from the first microphone and the second audio signal acquired from the second microphone to control the frequency characteristics of the audio signals, and to generate an output signal; a nonlinear amplification unit configured to control a signal level of the output signal acquired from the directivity sound pickup unit; and a hearing aid process control unit configured, when the hand placement determination unit determines that the state where the phase difference is the first threshold value or less continues for the first time, to control the directivity sound pickup unit such that at least one of the sensitivity-frequency characteristic and the frequency characteristics of the audio signals becomes nondirective, and to control the nonlinear amplification unit to amplify signal levels of the acquired audio signals.

The hearing aid device further includes a spectral variation extraction unit configured to divide the first audio signal acquired from the first microphone and the second audio signal acquired from the second microphone into at least two frequency bands of a first frequency band and a second frequency band higher than the first frequency band, and to calculate a first spectral variation of the first audio signal and the second audio signal for a second time in the first frequency band and a second spectral variation of the first audio signal and the second audio signal for the second time in the second frequency band. The hand placement determination unit is configured to determine whether the state where the phase difference is the first threshold value or less continues for the first time, to determine whether the first spectral variation is a second threshold value or less, and to determine whether the second spectral variation is a third threshold value or less. When the hand placement determination unit determines that the state where the phase difference is the first threshold value or less continues for the first time, determines that the first spectral variation is the second threshold value or less, and determines that the second spectral variation is the third threshold value or less, the hearing aid process control unit controls the directivity sound pickup unit such that at least one of the sensitivity-frequency characteristic and the frequency characteristics of the audio signal becomes nondirective, and controls the nonlinear amplification unit to amplify the signal levels of the acquired audio signals.

In the hearing aid device, the first frequency band is 800 Hz or less, and the second frequency band is 1 kHz to 3 kHz.

In the hearing aid device, the inter-signal phase difference calculation unit limits frequency bands of the first audio signal and the second audio signal to a third frequency band, and divides an absolute value of a subtraction result of the band-limited first audio signal and the band-limited second audio signal by an absolute value of an addition result of the band-limited first audio signal and the band-limited second audio signal, thereby calculating the phase difference.

In the hearing aid device, the third frequency band is 1 kHz to 3 kHz.

In the hearing aid device, when the hand placement determination unit determines that the state where the phase difference is the first threshold value or less continues for the first time, the hearing aid process control unit controls the directivity sound pickup unit such that at least one of the sensitivity-frequency characteristic and the frequency characteristics of the audio signals becomes nondirective, and controls the nonlinear amplification unit to amplify the signal levels of the acquired audio signals, and subsequently, when the hand placement determination unit determines that the state where the phase difference is the first threshold value or less does not continue for the first time, the hearing aid process control unit performs control to return at least one of the sensitivity-frequency characteristic and the frequency characteristics of the audio signals controlled nondirectively to a normal state.

The present invention provides a hearing aid method for a hearing aid device that includes a plurality of microphones configured to convert picked sound to audio signals, the method including: calculating, at an inter-signal phase difference calculation unit, a phase difference between a first audio signal converted by a first microphone of the plurality of microphones and a second audio signal converted by a second microphone of the plurality of microphones; determining, at a hand placement determination unit, whether a state where the phase difference is a first threshold value or less continues for a first time; superimposing, at a directivity sound pickup unit, a sensitivity-frequency characteristic for controlling sensitivity in a sound pickup direction on the first audio signal acquired from the first microphone and the second audio signal acquired from the second microphone to control the frequency characteristics of the audio signals, and generating an output signal; controlling, at a nonlinear amplification unit, a signal level of the output signal acquired from the directivity sound pickup unit; and controlling, at a hearing aid process control unit, the directivity sound pickup unit such that at least one of the sensitivity-frequency characteristic and the frequency characteristics of the audio signals becomes nondirective, and controlling the nonlinear amplification unit to amplify the signal levels of the acquired audio signals, when the hand placement determination unit determines that the state where the phase difference is the first threshold value or less continues for the first time.

The present invention provides a hearing aid method for a hearing aid device that includes a plurality of microphones configured to convert picked sound to audio signals, the method including: calculating, at an inter-signal phase difference calculation unit, a phase difference between a first audio signal converted by a first microphone of the plurality of microphones and a second audio signal converted by a second microphone of the plurality of microphones; dividing, a spectral variation extraction unit, the first audio signal and the second audio signal into two frequency bands of a first frequency band and a second frequency band higher than the first frequency band, and calculating a first spectral variation of the first audio signal and the second audio signal for a first time in the first frequency band and a second spectral variation of the first audio signal and the second audio signal for the first time in the second frequency band: determining, at a hand placement determination unit, whether a state where the phase difference is a first threshold value or less continues for a second time, determining whether the first spectral variation is a second threshold value or less, and determining whether the second spectral variation is a third threshold value or less; superimposing, at a directivity sound pickup unit, a sensitivity-frequency characteristic for controlling sensitivity in a sound pickup direction on the first audio signal acquired from the first microphone and the second audio signal acquired from the second microphone to control the frequency characteristics of the audio signals, and generating an output signal; controlling, at a nonlinear amplification unit, the signal level of the output signal acquired from the directivity sound pickup unit; and controlling, at a hearing aid process control unit, the directivity sound pickup unit such that at least one of the sensitivity-frequency characteristic and the frequency characteristics of the audio signals becomes nondirective, controlling the nonlinear amplification unit to amplify the signal levels of the acquired audio signals, when the hand placement determination unit determines that the state where the phase difference is the first threshold value or less continues for the second time, determines that the first spectral variation is the second threshold value or less, and determines that the second spectral variation is the third threshold value or less.

Advantages of the Invention

According to a hearing aid device and a hearing aid method of the present invention, a directivity process or an amplification process in a hearing aid can be controlled with a user's hand placement so as to match a user's intuition.

MODE FOR CARRYING OUT THE INVENTION

Hereinafter, embodiments of the invention will be described with reference to the drawings.

First Embodiment

In a first embodiment of the invention, a hand placement detection method using a temporal change in a phase difference will be described with reference to FIGS. 1 to 10.

A hand placement is a motion which is generally performed by a user when the user wants to hear forward sound more clearly, a motion for covering the left or right ear with the corresponding hand. That is, the user faces sound desired to be heard, and turns the palm of his/her hand to sound desired to be heard. The position of the hand is backward of the auricle, and in many cases, a part of the hand comes into contact with the auricle. The hand is somewhat rounded compared to a state of being stretched straight, and in general, the fingers other than the thumb are not separated from each other and are in contact with each other.

<Configuration of Hand Placement Detection Device 1>

Figure 1:
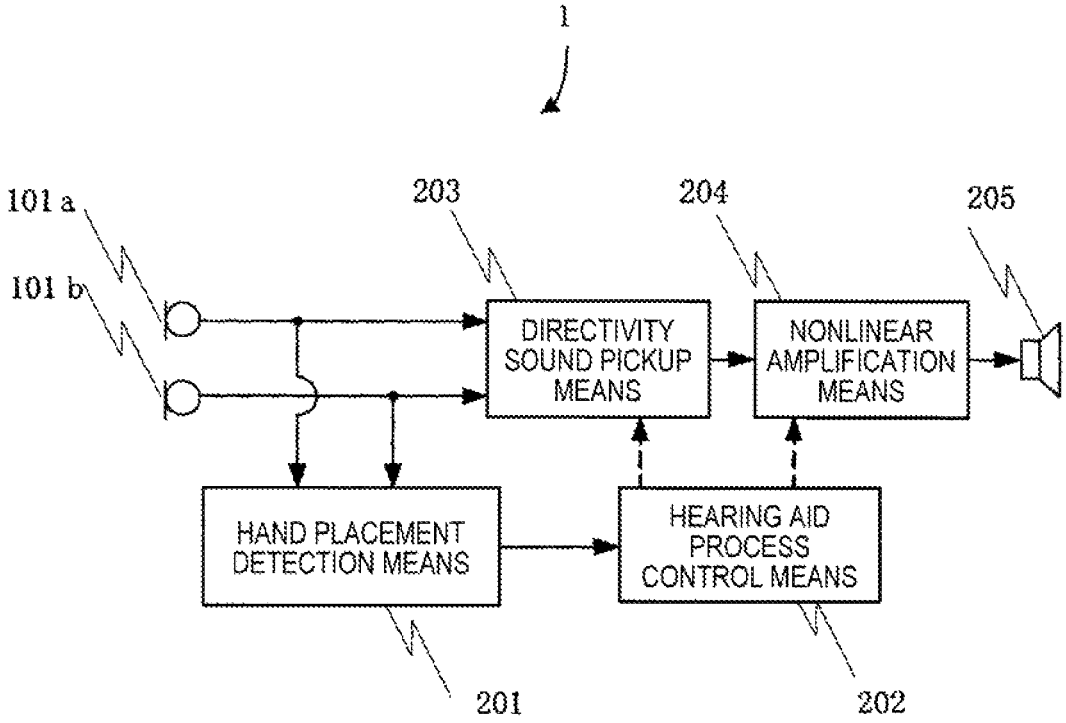
FIG. 1 is a block diagram showing the configuration of a hand placement detection device 1 of a first embodiment.

FIG. 1 is a block diagram showing the configuration of a hand placement detection device 1 of the first embodiment. The hand placement detection device 1 shown in FIG. 1 includes nondirective microphones 101*a* and 101*b*, hand placement detection means 201, hearing aid process control means 202, directivity sound pickup means 203, nonlinear amplification means 204, and a receiver 205.

Figure 2:
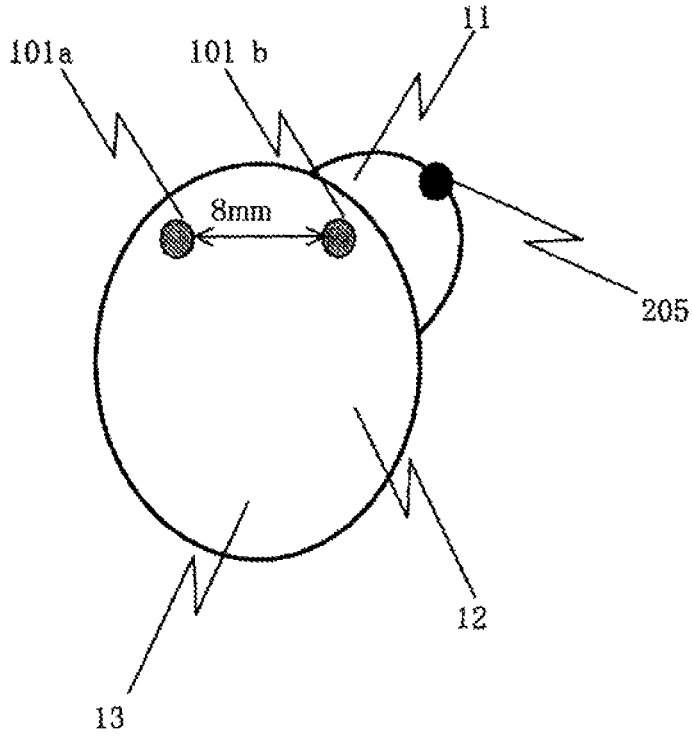
FIG. 2 is a schematic configuration diagram of an in-the-canal hearing aid 11 including the hand placement detection device 1.

In this embodiment, the hand placement detection device 1 is incorporated in the main body of an in-the-canal hearing aid (also referred to as a completely in the canal (CIC) hearing aid, a canal hearing aid, a half shell hearing aid, or a full shell hearing aid) 11 shown in FIG. 2. FIG. 2 is a schematic configuration diagram showing the configuration of the in-the-canal hearing aid 11 including the hand placement detection device 1 of this embodiment. As shown in FIG. 2, the in-the-canal hearing aid 11 includes a directivity control mode selector switch 12 and a volume switch 13, in addition to the nondirective microphones 101*a* and 101*b* and the receiver 205 constituting a part of the hand placement detection device 1.

In FIG. 1, the nondirective microphones 101*a* and 101*b* (hereinafter, referred to as microphones 101*a* and 101*b*) convert sound reaching the microphones 101*a* and 101*b* to audio signals. The audio signals input from the microphones 101*a* and 101*b* are output to the hand placement detection means 201 and the directivity sound pickup means 203. In this embodiment, as shown in FIG. 2, the interval between the microphone 101*a* and the microphone 101*b* is set to 8 millimeters.

The hand placement detection means 201 performs a hand placement determination process for determining whether or not a person with the in-the-canal hearing aid 11 performs a hand placement from the audio signals input from the microphones 101*a* and 101*b*. The details of the hand placement determination process in the hand placement detection means 201 will be described below. The determination result of the hand placement determination result is output to the hearing aid process control means 202.

Figure 3:
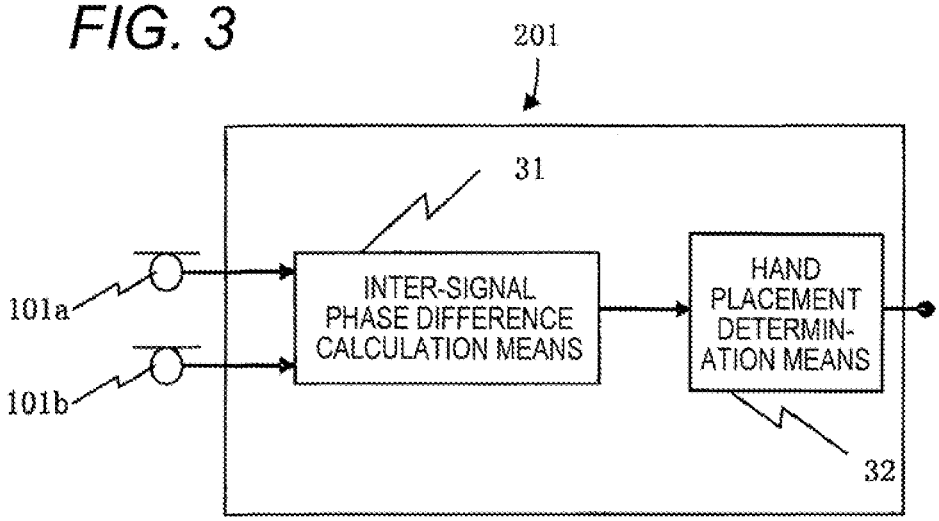
FIG. 3 is a block diagram of hand placement detection means 201.

The configuration of the hand placement detection means 201 shown in FIG. 2 will be described with reference to FIG. 3. FIG. 3 is a block diagram of the hand placement detection means 201. The hand placement detection means 201 shown in FIG. 3 includes inter-signal phase difference calculation means 31 and hand placement determination means 32. The hand placement detection means 201 has a function of monitoring the presence/absence of a phase difference between signals in a specific band to detect a hand placement state over an ear. The hand placement detection means 201 performs a hand placement determination process, and the details of the process will be described below.

The inter-signal phase difference calculation means 31 calculates a phase difference between the audio signals input from the microphones 101*a* and 101*b*, and outputs the phase difference to the hand placement determination means 32.

Figure 4:
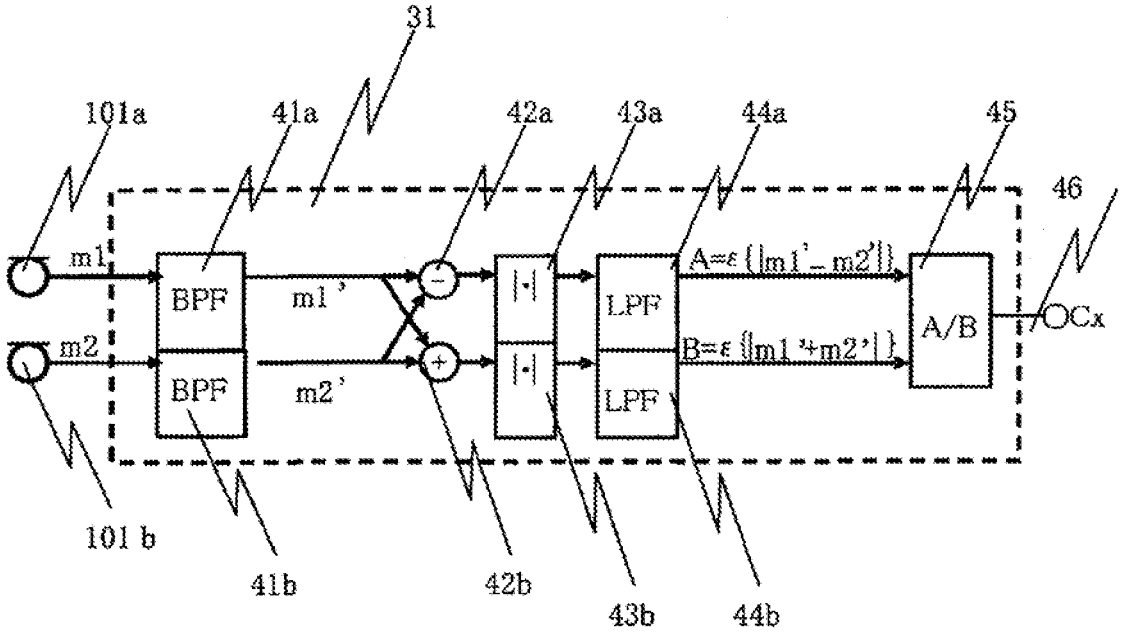
FIG. 4 is a block diagram showing the configuration of inter-signal phase difference calculation means 31.

A method of detecting a phase difference between the audio signals input from the microphones 101*a* and 101*b* will be described with reference to FIG. 4. For description, in order to distinguish the microphones 101*a* and 101*b* from each other, the microphone 101*a* is referred to as a first microphone 101*a*, and the microphone 101*b* is referred to as a second microphone 101*b*. FIG. 4 is a block diagram showing the configuration of the inter-signal phase difference calculation means 31. As shown in FIG. 4, the inter-signal phase difference calculation means 31 includes first band-pass filter means 41*a*, second band-pass filter means 41*b*, signal subtraction means 42*a*, signal addition means 42*b*, first absolute value calculation means 43*a*, second absolute value calculation means 43*b*, first signal smoothing means 44*a*, second signal smoothing means 44*b*, and phase difference level calculation means 45.

The first band-pass filter means 41*a* performs a process for limiting the signal band of an audio signal m1 input from the first microphone 101*a*, and outputs a band-limited audio signal m1' to the signal subtraction means 42*a* and the signal addition means 42*b*.

The second band-pass filter means 41*b* performs a process for limiting the signal band of an audio signal m2 input from the second microphone 101*b*, and outputs a band-limited audio signal m2' to the signal subtraction means 42*a* and the signal addition means 42*b*.

The signal subtraction means 42*a* performs a process for subtracting the audio signal m1' input from the first band-pass filter means 41*a* and the audio signal m2' input from the second band-pass filter means 41*b*. The signal subtraction means 42*a* outputs a subtracted audio signal (m1'−m2') to the first absolute value calculation means 43*a*.

The signal addition means 42*b* performs a process for adding the audio signal m1' input from the first band-pass filter means 41*a* and the audio signal m2' input from the second band-pass filter means 41*b*. The signal addition means 42*b* outputs an added audio signal (m1'+m2') to the second absolute value calculation means 43*b*.

The first absolute value calculation means 43*a* performs a process for calculating the absolute value |m1'−m2'| of the audio signal input from the signal subtraction means 42*a*, and outputs the calculated absolute value |m1'−m2'| to the first signal smoothing means 44*a*.

The second absolute value calculation means 43*b* performs a process for calculating the absolute value |m1'+m2'| of the audio signal input from the signal addition means 42*b*, and outputs the calculated absolute value |m1'+m2'| to the second signal smoothing means 44*b*.

The first signal smoothing means 44*a* performs a process for smoothing the absolute value |m1'−m2'| input from the first absolute value calculation means 43*a*, and outputs a smoothened power signal B (=ϵ|m1'+m2'|) to the phase difference level calculation means 45.

The second signal smoothing means 44*b* performs a process for smoothing the absolute value |m1'+m2'| input from the second absolute value calculation means 43*b*, and outputs a smoothened power signal B (=ϵ|m1'+m2'|) to the phase difference level calculation means 45. In the drawing, ϵ represents computation of the smoothing process.

The phase difference level calculation means 45 performs a process for dividing the power signal A input from the first signal smoothing means 44*a* by the power signal B input from the second signal smoothing means 44*b*. The phase difference level calculation means 45 calculates a phase difference level A/B without depending on an input sound pressure level, and outputs the phase difference level A/B to the subsequent hand placement determination means 32 as a parameter Cx.

The hand placement determination means 32 determines whether or not the person with the in-the-canal hearing aid 11 performs a hand placement based on the audio signal phase difference input from the inter-signal phase difference calculation means 31. A method for the hand placement determination process will be described below.

The determination result of the hand placement determination process is output to the hearing aid process control means 202.

The hearing aid process control means 202 controls parameters of the directivity sound pickup means 203 and the nonlinear amplification means 204 described below. The hearing aid process control means 202 controls the directivity sound pickup means 203 and the nonlinear amplification means 204 based on the determination result of the hand placement determination process of the hand placement detection means 201.

The directivity sound pickup means 203 performs a process for providing directivity to the audio signals input from the microphones 101*a* and 101*b* under the control of the hearing aid process control means 202. The audio signals subjected to the directivity process are output to the nonlinear amplification means 204.

The nonlinear amplification means 204 performs a process for amplifying the audio signals subjected to the directivity process in the directivity sound pickup means 203 under the control of the hearing aid process control means 202. The nonlinear amplification means 204 performs a process for multiplying a gain in accordance with the level of an input signal so as to match the aural characteristics of the person with the hearing aid under the control of the hearing aid process control means 202, thereby changing the level of an output signal. An amplified audio signal is output to the receiver 205.

The receiver 205 performs a receiver-directivity signal process on the audio signal amplified by the nonlinear amplification means 204. The audio signal processed by the receiver 205 is output toward the ear canal of the person with the in-the-canal hearing aid 11 as sound.

<Operation of Hand Placement Detection Device 1>

The following description will be provided as to the operation of the hand placement detection device 1 of this embodiment.

Figure 5:
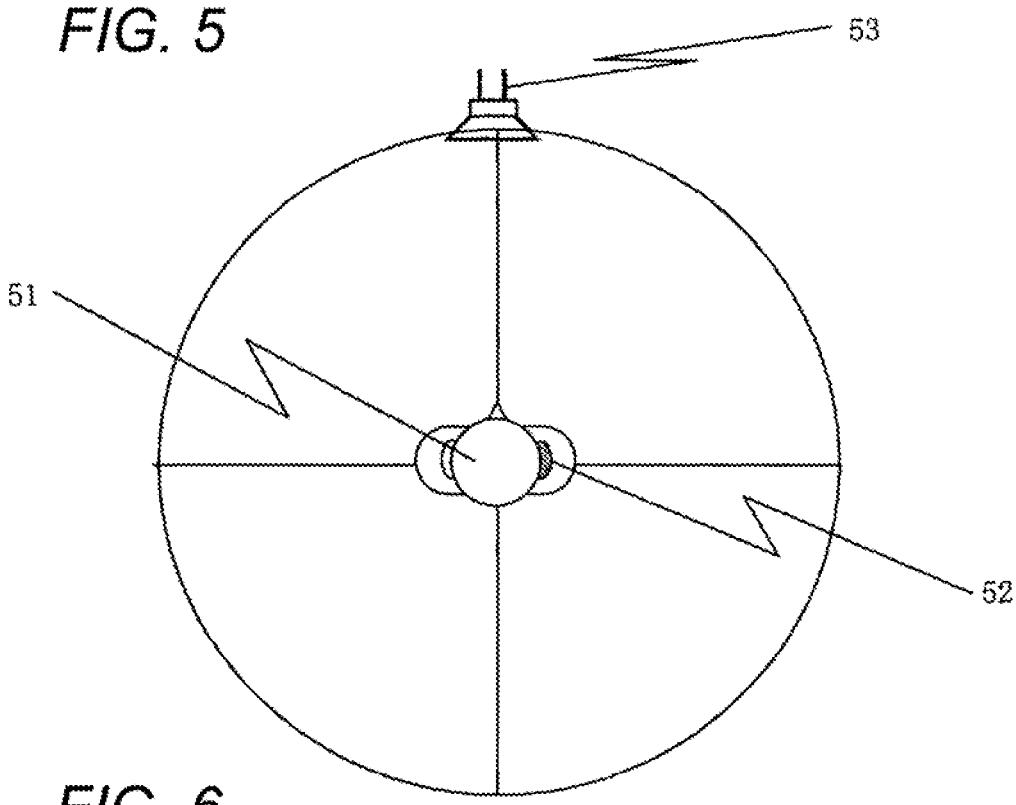
FIG. 5 is a diagram illustrating a change in a phase difference due to a hand placement over an ear.

In the hand placement detection device 1 of this embodiment, it is determined whether the person with the in-the-canal hearing aid 11 performs a hand placement based on a change in the phase difference calculated from input signals of two microphones. The principle will be described with reference to FIG. 5. FIG. 5 is an arrangement diagram illustrating a change in a phase difference due to a hand placement over an ear.

The in-the-canal hearing aid 11 having the hand placement detection device 1 of this embodiment includes two microphones.

In FIG. 5, it is assumed that a user 51 is fitted with in-the-canal hearing aid 11 having the hand placement detection device 1 of this embodiment, and the in-the-canal hearing aid 11 is mounted in the right ear 52 of the user 51. A speaker 53 serving as a sound source is arranged in front of the user 52. The hand placement detection device 1 can measure a change in a phase difference between the outputs of the two microphones due to a hand placement over the ear of the person with the in-the-canal hearing aid 11.

In the state of FIG. 5, if sound output from the speaker 53 reaches the in-the-canal hearing aid 11 in the right ear of the user 52, sound is input to the hand placement detection device 1 of the in-the-canal hearing aid 11, and the hand placement determination process starts.

Figure 6:
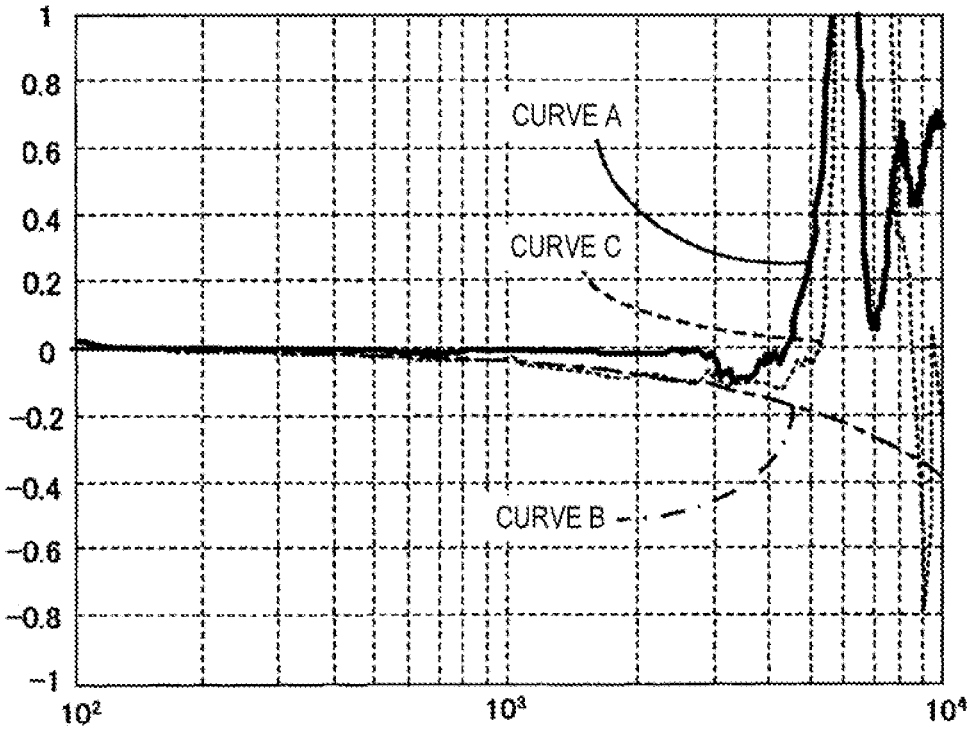
FIG. 6 is a graph showing a change in a phase difference due to a hand placement over an ear.

A change in a phase difference when the user 51 actually places his/her hand over his/her right ear 52, and the hand placement detection device 1 of the in-the-canal hearing aid 11 detects the hand placement will be described with reference to FIG. 6, FIG. 6 is a graph showing a change in a phase difference due to a hand placement over an ear.

FIG. 6 shows the measurement result of a phase difference between the two channel inputs of the microphones 101*a* and 101*b* in the in-the-canal hearing aid 11 mounted in the right ear 52 of the user 51 when wideband white noise is output from the speaker 53 in FIG. 5. In FIG. 6, the horizontal axis represents the logarithm of a frequency (Hz), and the vertical axis represents a phase difference (rad).

In FIG. 6, a curve C (in the drawing, a broken line) shows the measurement result of the phase difference between the two channel inputs of the microphones 101*a* and 101*b* in a state where the user 51 is fitted with the in-the-canal hearing aid 11 in his/her right ear, and does not place his/her hand over the auricle (a state where both hands are put down). In FIG. 6, a curve A (in the drawing, a solid line) shows the measurement result of the phase difference between the two channel inputs of the microphones 101*a* and 101*b* in a state where the user 51 is fitted with the in-the-canal hearing aid 11 in his/her right ear, and places the palm of his/her right hand backward of the auricle.

A curve B (in the drawing, a one-dot-chain line) shows a phase difference when two microphones are placed in front and at the back of a sound source (speaker 53) in a free space. In this embodiment, if a microphone interval is 2 mm smaller than the actual microphone interval, 8 mm, at a frequency equal to or lower than 2 kHz, the phase difference can approximate a curve in a state where no hand is placed over the auricle, as indicated by the curve C.

The reason for matching an actual measurement value is as follows. When an interval is set to be smaller than the actual microphone interval, there is no physical factor which obstructs incoming sound in a free space, and a phase difference is generated depending on the interval between the microphones. However, in the measurement system of FIG. 5, since the microphones are actually mounted in the canals of a person with auricles, not in a free space, the auricles already act to decrease the phase difference with respect to the free space. If a hand is placed over an auricle, the same effect as when the auricle increases is obtained, and the phase difference decreases. This is the measurement result indicated by the curve C.

That is, if a hand is placed over an ear, the physical presence of the palm of the hand changes the sound space near the microphone in a form such that input sound to a microphone is reflected by the palm of the hand and concentrated toward the ear, thereby decreasing the phase difference. In particular, at a frequency near 1 kHz to 3 kHz, when a hand is placed backward of the auricle (the characteristic indicated by the curve A of FIG. 6), a phenomenon that the phase difference becomes close to zero can be confirmed.

<Hand Placement Determination Process>

The hand placement determination means 32 of the hand placement detection device 1 of this embodiment determines the presence/absence of a hand placement using a change in the phase difference between input sound of two microphones due to a hand placement. Hereinafter, a method of determining the presence/absence of a hand placement based on a phase difference between input sound of two microphones in the hand placement determination means 32 will be described. Description will be provided focusing on that, when a hand is placed over an ear, a phase difference between the two microphones 101*a* and 101*b* in a specific frequency band becomes close to zero, regardless of the incoming direction of the sound waves.

First, the first band-pass filter 41*a* and the second band-pass filter 41*b* band-limit the audio signals m1 and m2 input from the first microphone 101*a* and the second microphone 101*b* to a band in which a change in the phase difference between signals due to a hand placement is noticeable. In this embodiment, the frequency band for band limit in the first band-pass filter 41*a* and the second band-pass filter 41*b* is determined based on the measurement result indicated by the curve A of FIG. 6. In this embodiment, the frequency band is 1 kHz to 3 kHz.

Next, in the signal subtraction means 42*a*, the difference between the signal m1' and the signal m2' is calculated, but in a hand placement state, since the phase difference becomes close to zero, the subtraction result becomes close to zero. In a normal state which is not the hand placement state, since there is a phase difference between the signals, the subtraction result does not become zero, and a remainder signal remains. The magnitude of the remainder signal depends on a difference in the incoming times between sound waves to two microphones, that is, the incoming direction.

Considering immediately before a hand placement is performed over an ear, that is, when it is desired to hear forward sound better, it can be assumed that there is at least a sound source in front. In this case, if there is no hand placement, there is a phase difference between the signal m1' and the signal m2' based on the sound velocity at a distance between the microphones. For this reason, a signal based on the sound waves is observed from the output signal of the signal subtraction means 42*a*, making it possible to detect a difference from when the phase difference becomes close to zero after the hand placement is performed.

Next, the signal addition means 42*b* is provided to add the signal m1' and the signal m2', and to obtain an output signal in proportion to the sound pressure level of the incoming sound waves to the microphones to normalize the signal level from the signal subtraction means 42*a*. Although in the above description, with regard to the audio signal (m1'−m2') from the signal subtraction means 42*a*, in the hand placement state, the output becomes close to zero, actually, there is no case where the output completely becomes zero, and there is a certain amount of remainder.

Thus, the output signal level from the signal subtraction means 42*a* in the hand placement state changes depending on the original levels of the incoming sound waves. In order to detect a hand placement state by threshold value determination based on the output signal (m1'−m2') from the signal subtraction means 42*a*, it is necessary to convert the output signal to the parameter Cx without depending on the sound pressure levels of the incoming sound waves to the first microphone 101*a* and the second microphone 101*b*.

Accordingly, the first absolute value calculation means 43*a* and the second absolute value calculation means 43*b* calculate the |m1'−m2'| of the output signal of the signal subtraction means 42*a* and the |m1'−m2'| of the output signal of the signal addition means 42*b* so as to obtain the incoming sound pressure levels to the first microphone 101*a* and the second microphone 101*b* and the sound pressure level of the remainder signal.

Next, the first signal smoothing means 44*a* and the second signal smoothing means 44*b* calculate the power signal A and the power signal B as the index of the sound pressure level by using, for example, a first-order integrator on the outputs of the first absolute value calculation means 43*a* and the second absolute value calculation means 43*b*.

Next, the phase difference level calculation means 45 divides the power signal A obtained by subtracting the input signals input from the two microphones of the first microphone 101*a* and the second microphone 101*b* by the power signal B obtained by adding the input signals to calculate a phase difference level without depending on the input sound pressure levels, and outputs the phase difference level as the parameter Cx. In this way, in the inter-signal phase difference calculation means 31, it becomes possible to extract the inter-signal phase difference between the input signals from the two microphones being close to zero in a specific frequency band due to a hand placement by a person who is fitted with the in-the-canal hearing aid 11 having the hand placement detection device 1 of this embodiment, without depending on the input sound pressure levels to the two microphones.

When a state where the parameter Cx input from the phase difference level calculation means 45 is equal to or smaller than a certain threshold value continues for a given time, the hand placement determination means 32 determines that the person who is fitted with the in-the-canal hearing aid 11 having the hand placement detection device 1 performs a hand placement. When a state where the parameter Cx input from the phase difference level calculation means 45 is equal to or smaller than a certain threshold value does not continue for a given time, the hand placement determination means 32 determines that the person who is fitted with the in-the-canal hearing aid 11 having the hand placement detection device 1 does not perform a hand placement. The hand placement determination process of the hand placement detection means 201 is performed as described above.

When a state where the parameter Cx input from the phase difference level calculation means 45 is equal to or smaller than a predetermined threshold value continues for a given time, the hand placement determination means 32 determines that the person who is fitted with the in-the-canal hearing aid 11 having the hand placement detection device 1 performs a hand placement, and calculates the time length for which the hand placement is continuously performed, that is, the hand placement time length. When a state where a hand placement is performed and a state where a hand placement is not performed are repeated within a given time, the hand placement determination means 32 calculates the number of hand placements within a given time, that is, the number of hand placements.

<Control 1 of Hearing Process in Hand Placement State>

The hearing aid process control means 202 controls the directivity sound pickup means 203 using the result of the hand placement determination process obtained in the above-described manner, such that the user can better hear sound through the in-the-canal hearing aid 11 in the hand placement state. In this embodiment, in the measurement result indicated by the curve A of FIG. 6, since the user 51 is fitted with the in-the-canal hearing aid 11 in his/her right ear, and places the palm of his/her right hand backward of the auricle, sound in front of the user can be highlighted and heard.

Figure 7:
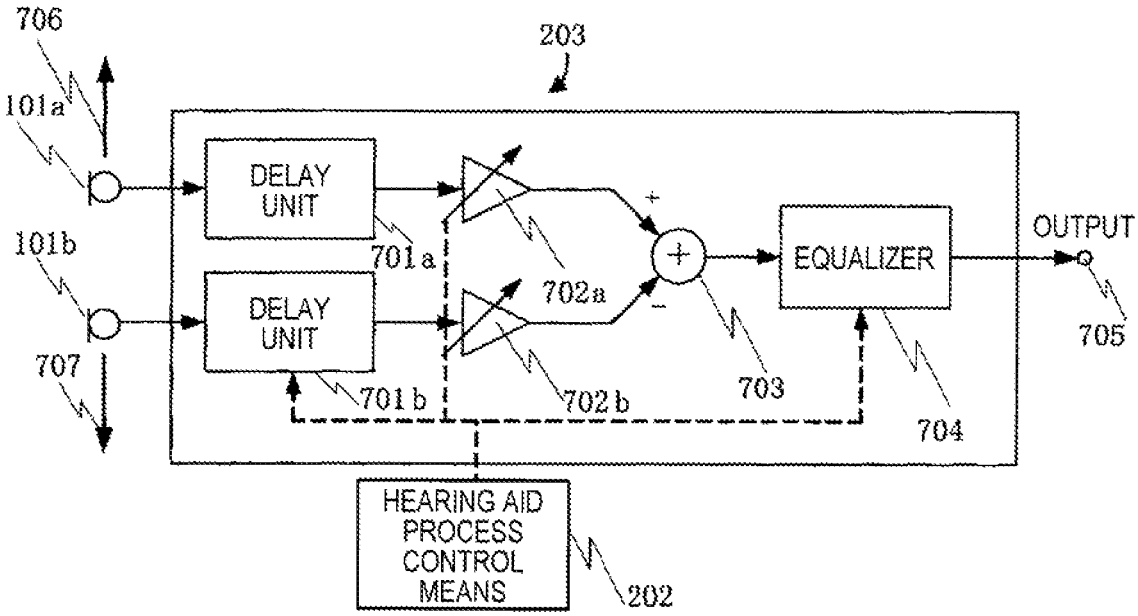
FIG. 7 is a block diagram showing the configuration of directivity sound pickup means 203.

A variation of a hearing aid process using the result of the hand placement determination process in this embodiment will be described with reference to FIG. 7. FIG. 7 is a block diagram showing the configuration of the directivity sound pickup means 203. The directivity sound pickup means 203 shown in FIG. 7 includes delay units 701*a* and 701*b*, variable amplifiers 702*a* and 702*b*, an adder 703, and an equalizer 704.

The delay units 701*a* and 701*b* perform a process for providing a predetermined delay amount to the audio signals input from the microphones 101*a* and 101*b*. The delayed audio signals are respectively output to the variable amplifiers 702*a* and 702*b*.

The variable amplifiers 702*a* and 702*b* perform a gain process for multiplying a predetermined gain value to the delayed audio signals. The audio signals subjected to the gain process are output to the adder 703.

The adder 703 performs a process for adding the two audio signals subjected to the gain process, and outputs the result to the equalizer 704.

The settings of the delay units 701*a* and 701*b* and the variable amplifiers 702*a* and 702*b* are determined depending on the shape of directivity formed by the microphones 101*a* and 101*b*. For example, when a blind spot of directivity is formed in a direction 707, first, a time difference τ corresponding to the time for which the sound waves propagate through a distance d between the microphones 101*a* and 101*b* is calculated by Expression 1. Here, c is the sound velocity.

[Mathematical Expression 1]

$$\tau = d/c \tag{1}$$

Next, the delay time in the delay unit 701*b* is set to be longer than the delay time in the delay unit 701*a* by the time corresponding to the time difference τ. In the variable amplifier 702*a*, +1 is set as the gain value which is multiplied to the input, and in the variable amplifier 702*b*, −1 is set as the gain value which is multiplied to the input.

Although the time when an incoming sound wave from the direction 707 reaches the microphone 101*a* is delayed by τ from the time when the sound wave reaches the microphone 101*b*, as described above, since the display time of the delay unit 701*b* is set to be greater than the delay time of 701*a* by τ, with regard to the signals output from delay unit 701*a* and 701*b*, there is no time difference between the waveforms of the sound wave from the direction 707. The variable amplifier 702*a* outputs the waveform with no phase inversion, and the variable amplifier 702*b* outputs the waveform with phase inversion.

The adder 703 adds the two waveforms output from the variable amplifier 702*a* and the variable amplifier 702*b*. This corresponds to subtracting the outputs of the delay units 701*a* and 701*b*, both outputs cancel each other, and with regard to the output of the adder 703, the blind spot of directivity can be formed in the direction 707. If the incoming direction of the sound wave is deviated from the direction 707, the time difference in the microphones 101*a* and 101*b* become smaller than τ. For this reason, a time difference is generated between the outputs of the delay units 701*a* and 701*b*, and with regard to the output of the adder 703, the outputs do not completely cancel each other, such that a residual component is generated.

The power of the residual component increases as the incoming direction of the sound wave is further deviated from the direction 707, and is maximum in a direction 706. In this way, directivity having a blind spot in the direction 707 is formed.

Figure 8:
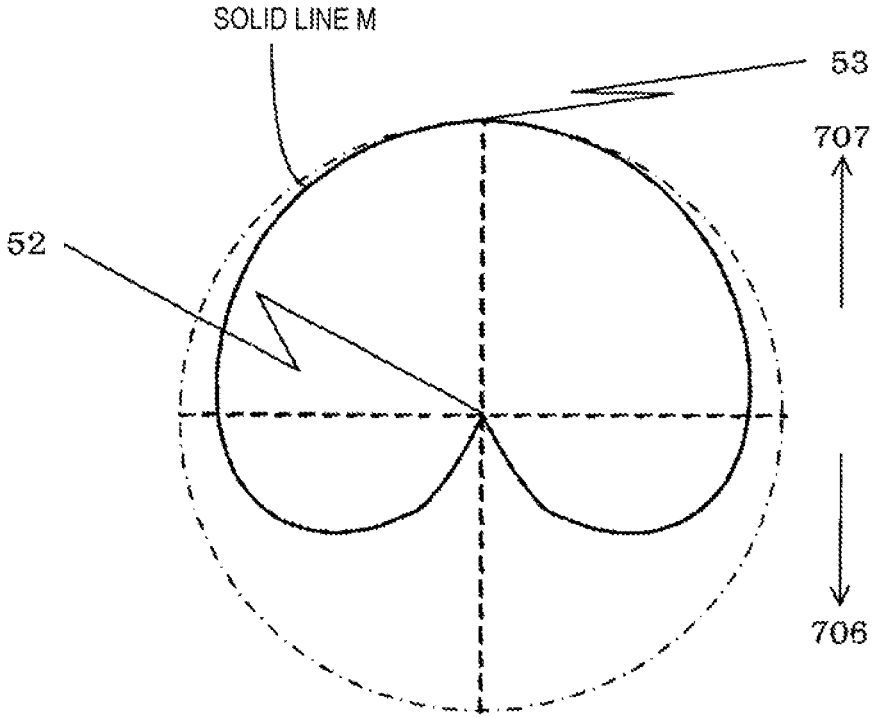
FIG. 8 is a schematic view of directivity when a directivity process is performed by the directivity sound pickup means 203.

FIG. 8 is a schematic view showing directivity when a directivity process is performed in the directivity sound pickup means 203 shown in FIG. 7. As shown in FIG. 8, when sound output from a sound source (speaker 53) is picked by the hand placement detection device 1 which is fitted to the user 52, a blind spot of directivity is formed in a direction corresponding to the direction 707 as indicated by a solid line M, and directivity is formed such that sensitivity in a direction corresponding to the direction 706 increases. At this time, focusing on the frequency characteristics of the audio signal output from the adder 703, when the above-described directivity is formed and a sound wave is incoming from the direction 706 having high sensitivity, the higher the frequency, the lower the sensitivity, compared to nondirectivity.

Figure 9:
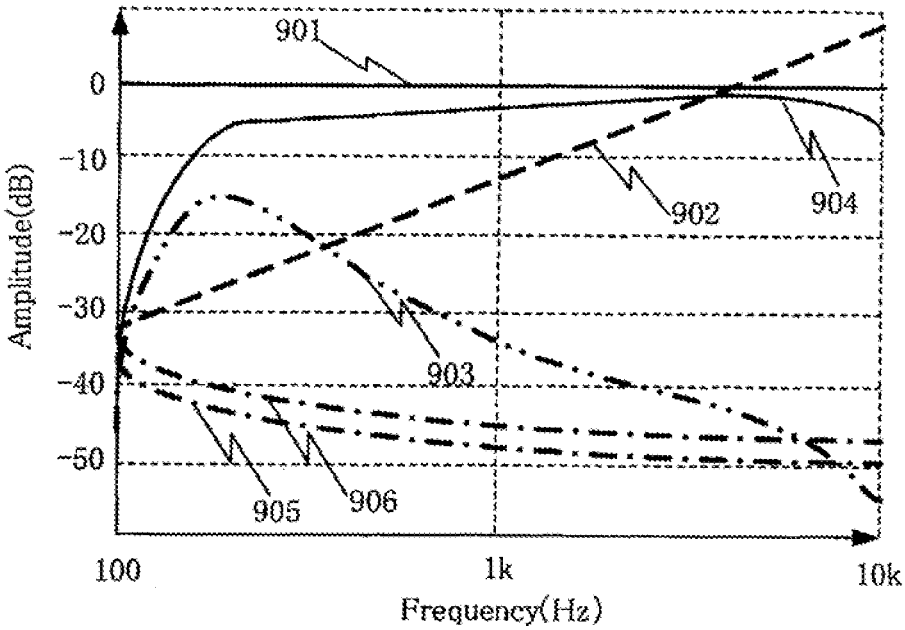
FIG. 9 is a graph showing a sensitivity-frequency characteristic and a circuit noise level frequency characteristic.

FIG. 9 shows a sensitivity-frequency characteristic and a circuit noise level frequency characteristic. In FIG. 9, the horizontal axis represents a frequency characteristic, and the vertical axis represents the relative value of amplitude. When a sound wave is input from the direction 706 shown in FIG. 7, in the case of nondirectivity, the sensitivity has a theoretically flat frequency characteristic, as indicated by a solid line 901 of FIG. 9. When the directivity shown in FIG. 8 is formed, as indicated by a broken line 902 of FIG. 9, the lower the frequency, the lower sensitivity. This is because, the lower the frequency, the smaller the phase difference between the outputs of the delay units 701*a* and 701*b*, and the smaller the power of the output of the adder 703.

In order to compensate for the reduction in sensitivity with the reduction in frequency indicated by the broken line 902 of FIG. 9, the directivity sound pickup means 203 of the hand placement detection device 1 performs a process for correcting the frequency characteristics under the control of the hearing aid process control means 202. The equalizer 704 shown in FIG. 7 performs a process for correcting the frequency characteristics of the output signal of the adder 703. With regard to the correction of the frequency characteristics, it is necessary to determine the characteristics of the equalizer 704 taking into consideration (1) the frequency characteristic of sensitivity with respect to the direction 706 shown in FIG. 7 being near flat, and (2) circuit noise generated inside a microphone being not excessively amplified.

An ECM (Electret Condenser Microphone) device which is used in the in-the-canal hearing aid 11 of this embodiment has, for example, circuit noise indicated by a one-dot-chain line 905 of FIG. 9. In general, the power of circuit noise increases in a low band. For this reason, when the directivity shown in FIG. 8 is formed, it is considered that the waveforms of circuit noise of the microphones 101*a* and 101*b* are independent of each other. For this reason, in the output of the adder 703 of the FIG. 7, the circuit noise level theoretically increases by 3 dB compared to a microphone alone, and the frequency characteristic indicated by a one-dot-chain line 906 of FIG. 9 is obtained.

With regard to the frequency characteristic of the equalizer 704 of this embodiment, if correction is made such that the sensitivity in the direction 706 of FIG. 7 is flat, the lower the frequency, the larger the gain. As a result, the circuit noise level in the output of the equalizer 704 increases particularly in a low band.

Accordingly, it is considered that the process for correcting the sensitivity with respect to the direction 706 shown in FIG. 7 is relieved in the low band. For example, the in-the-canal hearing aid 11 of this embodiment provides the characteristic indicated by a two-dot-chain line 903 of FIG. 9 to the equalizer 704. As a result, it is understood that, although the sensitivity with respect to the direction 706 shown in FIG. 7 is corrected as indicated by a solid line 904 of FIG. 9, the sensitivity is lowered in the low band compared to the solid line 901 of FIG. 9 indicating the sensitivity in the case of nondirectivity.

The circuit noise level in the output of the equalizer 704 is obtained by adding the circuit noise level 906 in the output of the adder 703 and the frequency characteristic 903 of the equalizer 704. The circuit noise level increases particularly in the low band, and becomes high compared to nondirectivity.

In a hearing aid having a plurality of microphones, for example, two or more microphones, the directivity shown in FIG. 8 is formed, a process for highlight sound in front of a person with a hearing aid is frequently performed. In order to form directivity, it is assumed that there is a time difference between incoming sound waves to two microphones in principle. However, as indicated by the solid line of FIG. 6, when a person with a hearing aid performs a hand placement, since the time difference becomes zero, desired directivity is not formed, and directivity close to nondirectivity is formed particularly at a frequency near 1 kHz to 3 kHz. In this case, while nondirectivity is formed, the circuit noise level also increases, sound in front of the person with the hearing aid 11 may not be highlighted, and circuit noise may be heard loudly.

In a situation in which the directivity shown in FIG. 8 is formed, when a hand placement is detected by the hand placement detection means 201, the hearing aid process control means 202 performs control such that the directivity sound pickup means 203 becomes nondirective. That is, although the gain value of the variable amplifier 702*b* is −1 when forming directivity, if the gain value is set to 0, only the output of the variable amplifier 702*a* is input to the adder 703, thereby forming nondirectivity.

In this case, in the equalizer 704, the characteristic indicated by the two-dot-chain line 903 of FIG. 9 which is required when forming directivity is not required, thereby providing a near-flat characteristic. As a result, the noise level can be maintained to be low.

As a result, in a situation in which the directivity shown in FIG. 8 is formed, when the hand placement detection device 1 detects a hand placement of the person with the hearing aid 11, as described, the parameter of the directivity sound pickup means 203 is changed, thereby forming nondirectivity. As a result, the person with the hearing aid can hear sound with low noise.

As described above, after the hand placement detection means 201 determines that a hand placement is performed, the parameter of the directivity sound pickup means 203 is changed. In this state, when the hand placement detection means 201 determines that a hand placement is not performed, the parameter of the directivity sound pickup means 203 returns to the normal state.

Accordingly, according to the hand placement detection device 1 of this embodiment, it is possible to highlight sound in front of the person with the hearing aid based on the phase difference between the signals input from two microphones in accordance with a hand placement of the person with the hearing aid 11. The hand placement detection device 1 can allow the person with the hearing aid to better hear sound through the hearing aid.

<Control 2 of Hearing Aid Process in Hand Placement State-Amplification Factor>

The following description will be provided as to a case where an amplification factor in the hearing aid 11 having the hand placement detection device 1 is controlled as one use method for hand placement detection. In FIG. 2, the nonlinear amplification means 204 multiplies a gain in accordance with an input level to control an output level so as to match the intuition of the person with the hearing aid under the control of the hearing aid process control means 202.

In the case of perceptive deafness with aging, in general, while low sound is not easily heard, loud sound is heard comparably to a person with good hearing. For this reason, as a nonlinear amplification process of the hearing aid 11, an amplification factor for low sound increases, and an amplification factor for loud sound is lowered. In this way, hearing aid of a person with hearing loss is performed such that hearing for low sound is secured and loud sound is not heard loudly.

Figure 10:
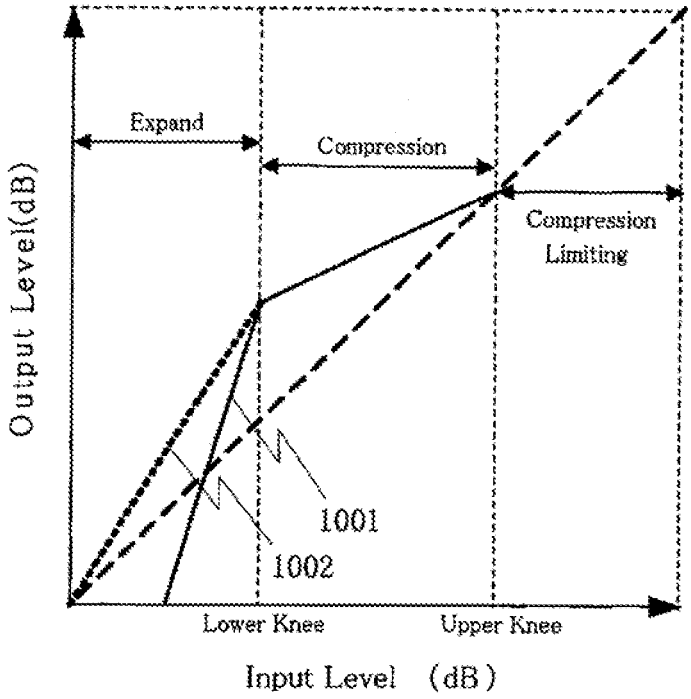
FIG. 10 is a diagram showing an example of an amplification characteristic of nonlinear amplification.

FIG. 10 shows an example of an amplification characteristic of nonlinear amplification. In FIG. 10, the horizontal axis represents an input level (dB), and the vertical axis represents an output level (dB). In FIG. 10, in a region Compression where the input level is about medium, the amplification factor is lowered as the input level increases, such that low sound is amplified significantly, and loud sound is output while the magnitude is not changed so much. In FIG. 10, in a region Compression Limiting where the input level is high, a so-called limiter process is performed in which, even when the input level increases, the output level is not changed, thereby reducing loudness due to loud sound or a sense of discomfort of the user.

In FIG. 10, in a region Expand where the input level is low, if the input level is lowered, the amplification factor is lowered significantly, thereby preventing low sound or the above-described circuit noise which is regarded as being usually unnecessary from being amplified and heard by the person with the hearing aid.

For example, in a normal case where a hand placement is not detected, it should suffice that the nonlinear amplification means 204 has the characteristic indicated by a line 1002 (in the drawing, a broken line) of FIG. 10. However, when sound that the person with the hearing aid wants to hear is in the region Expand, the output level is lowered even though the person with the hearing aid wants to hear sound, and the person with the hearing aid does not easily hear sound desired to be heard originally.

Accordingly, in this embodiment, when the input level is low, and when a hand placement is detected in the hand placement determination process of the hand placement detection means 201, the hearing aid process control means 202 controls the nonlinear amplification means 204 to increase the amplification factor such that the characteristic of the nonlinear amplification means 204 changes, for example, from the characteristic indicated by the broken line 1002 of FIG. 10 to the characteristic indicated by the solid line 1001 of FIG. 10. As a result, even low sound which is not easily heard by the person with the hearing aid in the normal characteristic can be easily heard.

In increasing the amplification factor, when a hand placement is detected in the hand placement determination process of the hand placement detection means 201, there is a method which increases the amplification factor at a time. There is also a method which changes the amplification factor in accordance with the hand placement time length calculated by the hand placement detection means 201, and increases the amplification factor as the hand placement time length is long. There is also a method which changes the amplification factor in accordance with the number of hand placements calculated by the hand placement detection means 201, and increases the amplification factor as the number of hand placements increases.

After the hand placement detection means 201 determines that a hand placement is performed, the amplification factor of the characteristic of the nonlinear amplification means 204 is changed and increases. In this state, when the hand placement detection means 201 determines that a hand placement is not performed, the amplification factor of the characteristic of the nonlinear amplification means 204 returns to the normal state.

Accordingly, according to the hand placement detection device 1 of this embodiment, the nonlinear amplification process is performed on the levels of the signals input from two microphones in accordance with a hand placement of the person with the hearing aid 11. For this reason, in the hand placement detection device 1, even low sound which is not easily heard by the person with the hearing aid 11 in the normal characteristic can be easily heard by the person with the hearing aid 11.

According to the hand placement detection device 1 of this embodiment, a configuration is made such that determination is performed by processing the input signals input two microphones, thereby detecting a hand placement without providing an additional sensor. Since an additional sensor is not provided, it is possible to detect a hand placement without causing an increase in the size of the hearing aid. It also becomes possible to change control of the hearing aid in accordance with a hand placement.

Although in this embodiment, a hearing aid having two microphones has been described, the invention can also be applied to a hearing aid having three or more microphones.

It becomes possible to detect a hand placement over an ear using input signals input from a plurality of microphones provided for a hearing aid process. It also becomes possible to control a hearing aid in accordance with an intention that the user wants to hear forward sound better by a gesture, without operating a small switch in a hearing aid which is not easily operated when being fitted.

Second Embodiment

Figure 12:
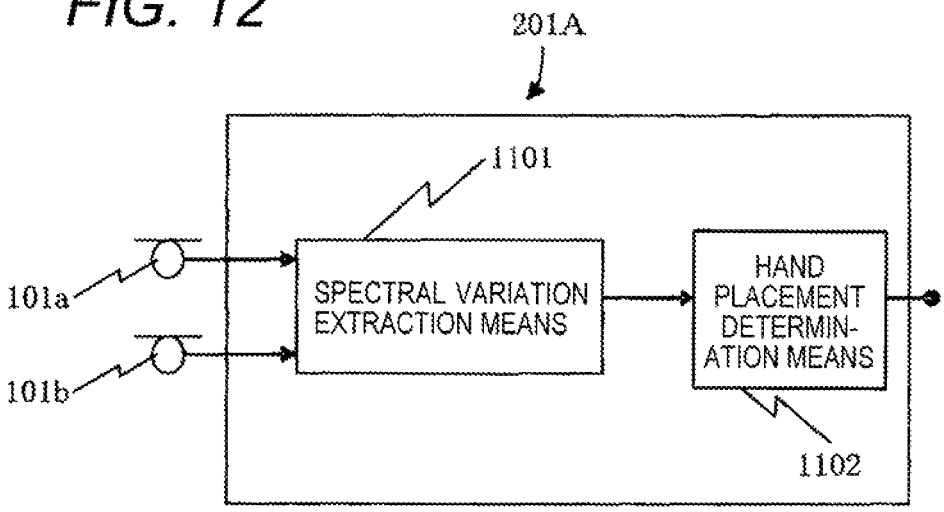
FIG. 12 is a block diagram showing the configuration of hand placement detection means 201A.
Figure 13:
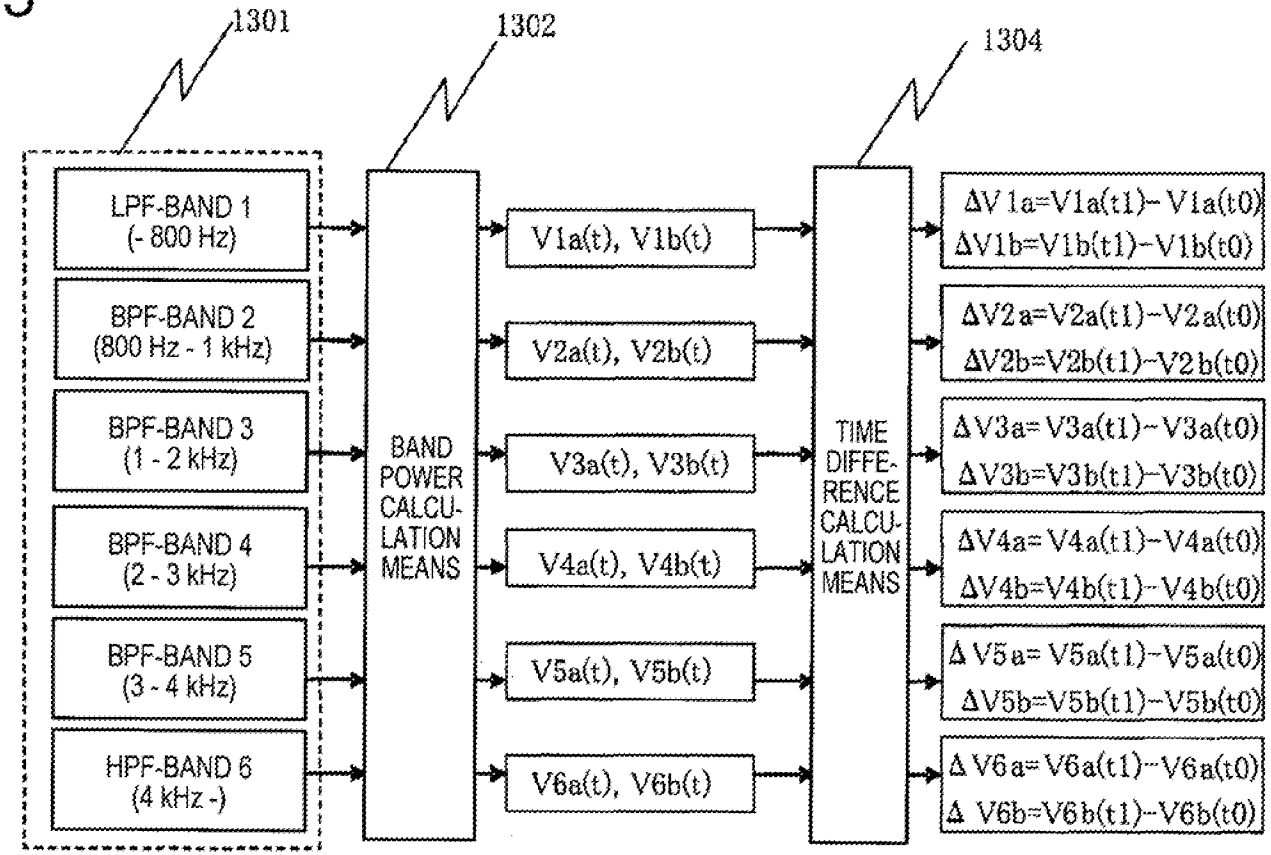
FIG. 13 is a block diagram showing the configuration of spectral variation extraction means 1101.

A method of detecting a hand placement using a temporal change in spectral power as a second embodiment of the invention will be described with reference to FIGS. 11 to 13.

<Configuration of Hand Placement Detection Device 2>

Figure 11:
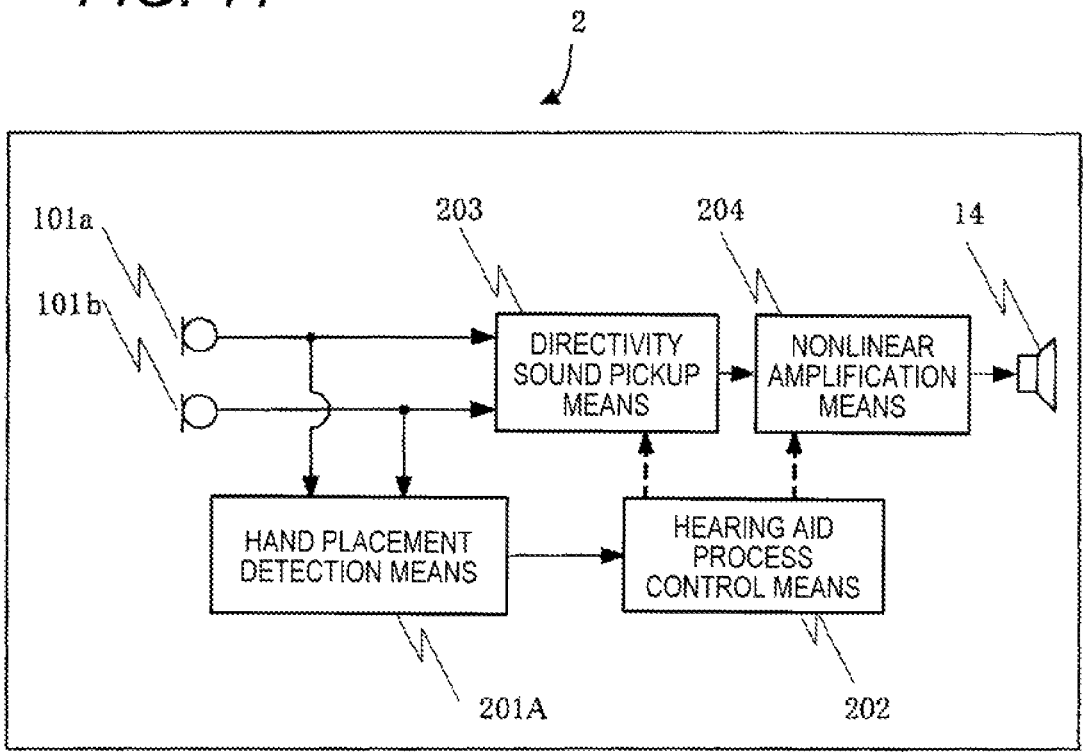
FIG. 11 is a block diagram showing the configuration of a hand placement detection device 2 of a second embodiment.

FIG. 11 is a block diagram showing the configuration of a hand placement detection device 2 of the second embodiment. A difference between the hand placement detection device 2 of the second embodiment and the hand placement detection device 1 of the first embodiment is the configuration of hand placement detection means. Except for this point, the second embodiment is the same as the first embodiment. In FIG. 11, the same constituent elements as those shown in FIG. 1 are represented by the same reference numerals. In this embodiment, the configuration other than the hand placement detection means is the same as in the first embodiment, thus detailed description thereof will be omitted.

In this embodiment, as in the first embodiment, the hand placement detection device 2 is incorporated in the main body of the in-the-canal hearing aid 11 shown in FIG. 2.

As shown in FIG. 11, the hand placement detection device 2 of the second embodiment includes nondirective microphones 101*a* and 101*b*, hand placement detection means 201A, hearing aid process control means 202, directivity sound pickup means 203, nonlinear amplification means 204, and a receiver 205.

In this embodiment, the configuration other than the hand placement detection means is the same as in the first embodiment, thus detailed description thereof will be omitted.

The configuration of the hand placement detection means 201A which is different from the hand placement detection device 1 of the first embodiment will be described with reference to FIG. 12. FIG. 12 is a block diagram showing the configuration of the hand placement detection means 201A. The hand placement detection means 201A shown in FIG. 12 includes spectral variation extraction means 1101 and hand placement determination means 1102.

The spectral variation extraction means 1101 extracts variations in spectral power of the audio signals input from the microphones 101*a* and 101*b*. The configuration of the spectral variation extraction means 1101 will be described with reference to FIG. 13. FIG. 13 is a block diagram showing the configuration of the spectral variation extraction means 1101. The spectral variation extraction means 1101 shown in FIG. 13 includes filter processing means 1301, band power calculation processing means 1302, and time difference calculation means 1304.

The filter processing means 1301 performs a process for dividing the audio signals input from the microphones 101*a* and 101*b* into six frequency bands. As shown in FIG. 13, the six frequency bands include, for example, an LPF-band 1 representing a frequency band equal to or lower than 800 Hz, a BPF-band 2 representing a frequency band higher than 800 Hz and equal to or lower than 1 kHz, a BPF-band 3 representing a frequency band higher than 1 kHz and equal to or lower than 2 kHz, a BPF-band 4 representing a frequency band higher than 2 kHz and equal to or lower than 3 kHz, a BPF-band 5 representing a frequency band higher than 3 kHz and equal to or lower than 4 kHz, and an HPF-band 6 representing a frequency band equal to or higher than 4 kHz.

The band power calculation processing means 1302 performs a process for calculating power specific to each band for the audio signals which are divided into the frequency bands by the filter processing means 1301. As shown in FIG. 13, it is assumed that power of the bands 1, 2, 3, 4, 5, and 6 of the audio signal input from the microphone 101*a* is V1*a*(t), V2*a*(t), V3*a*(t), V4*a*(t), V5*a*(t), and V6*a*(t). Similarly, it is assumed that power of each band 1, 2, 3, 4, 5, and 6 of the audio signal input from the microphone 101*b* is V1*b*(t), V2*b*(t), V3*b*(t), V4*b*(t), V5*b*(t), and V6*b*(t). Power is the power value for each time.

The time difference calculation means 1304 calculates spectral variations ΔVNa (=VNa(t1)−VNa(t0)) and ΔNb (=VNb(t1)−VNb(t0)) (where N is a natural number of 1 to 6) specific to microphone, band, and time from the difference between band-specific power values V1*a*(t1) to V6*a*(t1) and V1*b*(t1) to V6*b*(t1) calculated at the time t1 and band-specific power values V1*a*(t0) to V6*a*(t0) and V1*b*(t0) to V6*b*(t0) at the time t0 before a predetermined time from the time t1.

The calculated spectral variations ΔVNa and ΔVNb (where N is a natural number of 1 to 6) are output to the hand placement determination means.

The hand placement determination means 1102 determines the presence/absence of a hand placement based on the spectral variations ΔVNa and ΔVNb input from the time difference calculation means 1304. For example, the hand placement determination means 1102 divides a frequency band for determining the presence/absence of a hand placement into a low band, a medium band, and a high band. Next, the hand placement determination means 1102 determines the presence/absence of a hand placement based on two bands of a temporal change in spectral power in the low band where there is no change in power due to a hand placement and a temporal change in spectral power in the medium band where there is a change in power due to a hand placement.

That is, if the spectral variations ΔVNa and ΔVNb input from the time difference calculation means 1304 are used, for example, in the low band where there is no change in power due to a hand placement, a time slot in which there is a little temporal change in spectral power is specified. When the spectral power in the medium band is changed to increase with time in the same time slot, it can be determined that there is a hand placement.

In other words, the hand placement determination means 1102 focuses on a spectral variation from the time t0 to the time t1 by the spectral variations ΔVNa and ΔVNb (where N is a natural number of 1 to 6). Thus, if the total value of the spectral variations ΔV1*a* and ΔV1*b* of the LPF-band 1 shown in FIG. 13 is equal to or smaller than a threshold value (Dth1), and the total value of the spectral variations ΔV3*a* and ΔV3*b* of the BPF-band 3 shown in FIG. 13 and the spectral variations ΔV4*a* and ΔV4*b* of the BPF-band 4 shown in FIG. 13 is equal to or greater than a threshold value (Dth2), the hand placement determination means 1102 can determine that there is a hand placement.

The hand placement determination means 1102 detects a motion of the person with the in-the-canal hearing aid 11 having the hand placement detection device 1 to cover his/her auricle with his/her hand. That is, when the person with the hearing aid covers his/her auricle with his/her hand, the power of sound input to the microphones 101*a* and 101*b* from outside is significantly reduced in a short time. From this, when a state where power is low continues for a given time compared to the power before a given time, it is determined that the person with the hearing aid takes a motion to cover his/her auricle. With regard to a band for determining a change in power, all the frequency bands may be used. Meanwhile, since power may not be lowered depending on the way of covering the auricle of the person with the hearing aid in the low frequency band, the frequency bands other than the low frequency band may be used. It is preferable that at least a portion of a band of 1 to 4 kHz is included in which there is little influence of the way of covering the auricle of the person with the hearing aid, and it can be generally expected there is ambient sound at a certain level.

In order to further increase the accuracy of hand placement determination, for example, the time to may be provided at five points for every one second, and a small time width may be provided at the time of determination on the condition that the total value of all spectral variations is equal to or greater than Dth2. Since external sound constantly changes, for example, a sound spectrum constantly changes phonologically, with changes in spectral power of all frequency bands, it is difficult to determine whether spectral power is changed due to a hand placement or sound variation. However, with this method, it becomes possible to detect a hand placement using a temporal change in spectral power.

Figure 14:
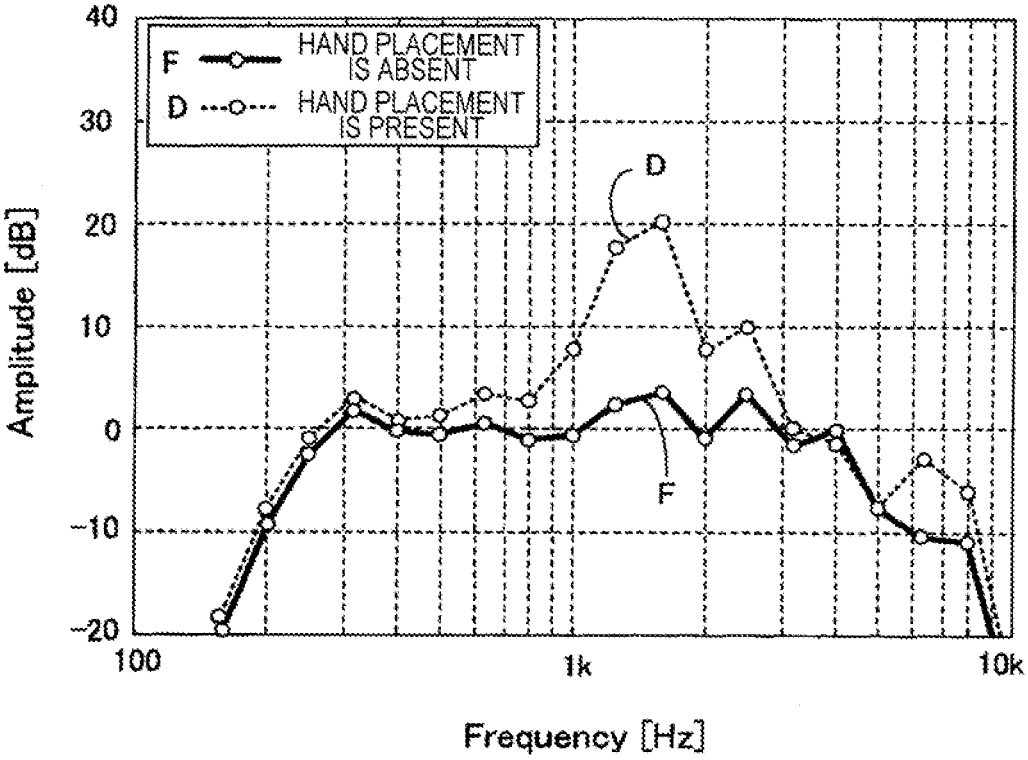
FIG. 14 is a diagram showing a temporal average of spectral power for determining the presence/absence of a hand placement in hand placement determination means 1102.

Next, FIG. 14 is a diagram showing a temporal average for determining the presence/absence of a hand placement in the hand placement determination means 1102. As in the first embodiment, it is assumed that the temporal average of spectral power shown in FIG. 14 is obtained by the arrangement shown in FIG. 5. That is, it is assumed that voice of a man output from the speaker 53 is input to the hand placement detection device 2 through the two microphones 101*a* and 101*b* in the in-the-canal hearing aid 11 having the hand placement detection device 2 mounted in the right ear 52 of the user 51 in the acoustic chamber.

FIG. 14 shows the measurement results of a temporal average in spectral power of two channel inputs from the microphones 101*a* and 101*b* when there is a hand placement over an ear and when there is no hand placement. The horizontal axis represents the logarithm of a frequency, and the vertical axis represents spectral power. A broken line F of FIG. 14 shows a measurement result when a hand is not placed over an auricle but is put down, and a broken line D of FIG. 14 shows a measurement result when a hand is placed over an auricle.

As shown in FIG. 14, a difference based on the presence/absence of a hand placement over an auricle noticeably appears as an increase in power at 1 kHz to 3 kHz, and there is little difference at equal to or lower than 800 Hz. This is because, when input sound to a microphone is reflected by the palm of the hand and concentrated toward the ear due to the physical presence of the palm of the hand, while the low frequency band which is easily routed intrinsically and the high frequency band which is easily attenuated intrinsically are slightly affected by the presence of the palm of the hand, the medium frequency band is most affected.

A temporal change in spectral power is observed by band, and if a temporal change in spectral power is small in the low frequency band, a change in sound is small. From this, if the spectral power of the medium frequency band changes, it is possible to determine the presence/absence of a hand placement.

In controlling the hearing aid process, there is a method in which, when it is determined that a hand placement is not performed for a given time, the parameter of the directivity sound pickup means 203 or the nonlinear amplification means 204 returns to the normal state, as described in the first embodiment, or there is a method which uses the determination of the hand placement determination means 1102 that a motion is perform to cover the auricle, as described in this embodiment.

That is, after the hand placement detection means 201 determines that a hand placement is performed, the parameter of the directivity sound pickup means 203 is changed. In this state, when the hand placement determination means 1102 determines that a motion is performed to cover the auricle, the parameter of the directivity sound pickup means 203 returns to the normal state. After the hand placement detection means 201 determines that a hand placement is performed, the amplification factor of the characteristic of the nonlinear amplification means 204 is changed to increase. In this state, when the hand placement determination means 1102 determines that a motion is performed to cover the auricle, the amplification factor of the characteristic of the nonlinear amplification means 204 returns to the normal state.

Therefore, according to the hand placement detection device 2 of this embodiment, it is possible to detect a hand placement based on a temporal change in power in a specific frequency band for signals input from two microphones.

According to the hand placement detection device 2 of this embodiment, a configuration is made such that determination is performed by processing the input signals input two microphones, thereby detecting a hand placement without providing an additional sensor.

Since an additional sensor is not provided, it is possible to detect a hand placement without causing an increase in the size of the hearing aid.

Although in this embodiment, a hearing aid having two microphones has been described, the invention can also be applied to a hearing aid having three or more microphones.

In this embodiment, a case has been described where a spectrum input from a microphone is divided into six bands. Meanwhile, it should suffice that a low-band spectrum and a high-band spectrum can be distinguished from each other, even when the number of divided frequency bands is greater or smaller than 6, the same effects can be obtained unless a spectrum is divided into two or more frequency bands.

Third Embodiment

As described in the foregoing first and second embodiments, it is possible to determine the presence/absence of a hand placement over an ear using either a temporal change in the phase difference between signals input from two microphones or a temporal change in spectral power. From the viewpoint of accuracy in determining the presence/absence of a hand placement, it is effective to use both temporal changes.

A method of detecting a hand placement using both a temporal change in a phase difference and a temporal change in spectral power as a third embodiment of the invention will be described.

Figure 15:
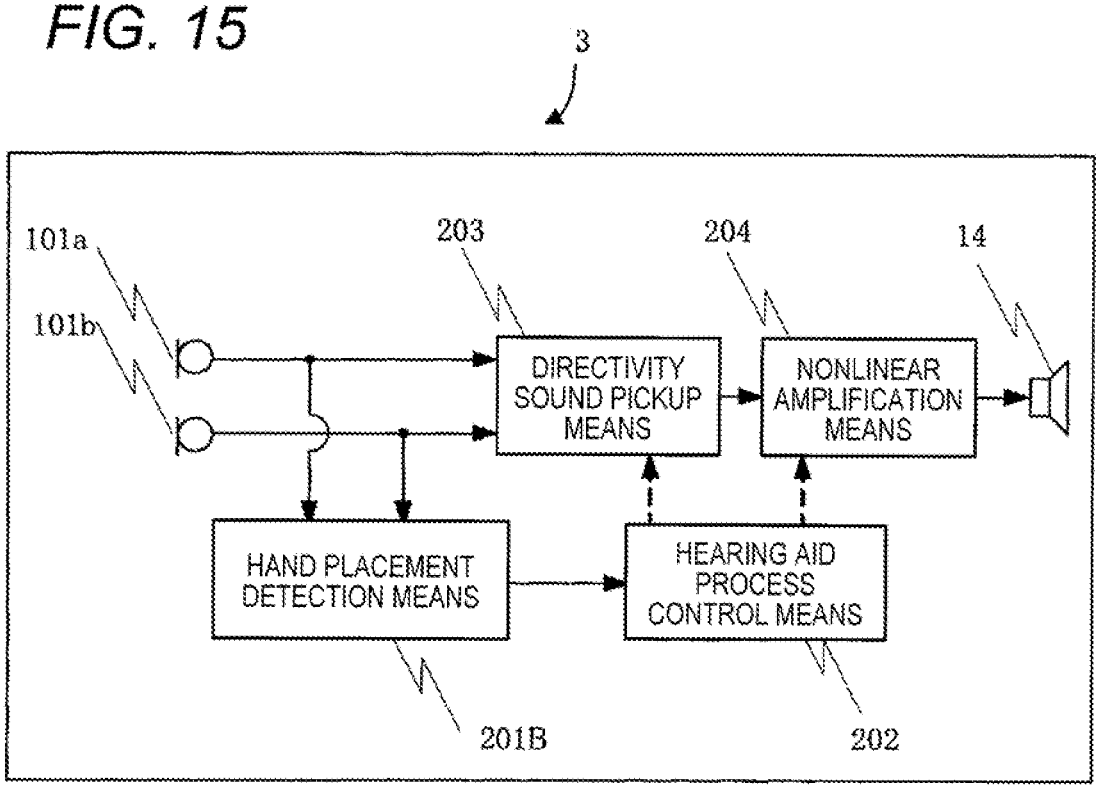
FIG. 15 is a block diagram showing the configuration of a hand placement detection device 3 of a third embodiment.

FIG. 15 is a block diagram showing the configuration of a hand placement detection device 3 of the third embodiment. A difference between the hand placement detection device 3 of the third embodiment and the hand placement detection device 1 of the first embodiment is the configuration of hand placement detection means. Except for this point, the third embodiment is the same as the first embodiment. In FIG. 15, the same constituent elements as those shown FIG. 1 are represented by the same reference numerals.

In this embodiment, as in the first embodiment, the hand placement detection device 3 is incorporated in the main body of the in-the-canal hearing aid 11 shown in FIG. 2.

As shown in FIG. 15, the hand placement detection device 3 of the third embodiment includes nondirective microphones 101*a* and 101*b*, hand placement detection means 201B, hearing aid process control means 202, directivity sound pickup means 203, nonlinear amplification means 204, and a receiver 205.

In this embodiment, the configuration other than the hand placement detection means is the same as in the first embodiment, thus detailed configuration thereof will be omitted.

Figure 16:
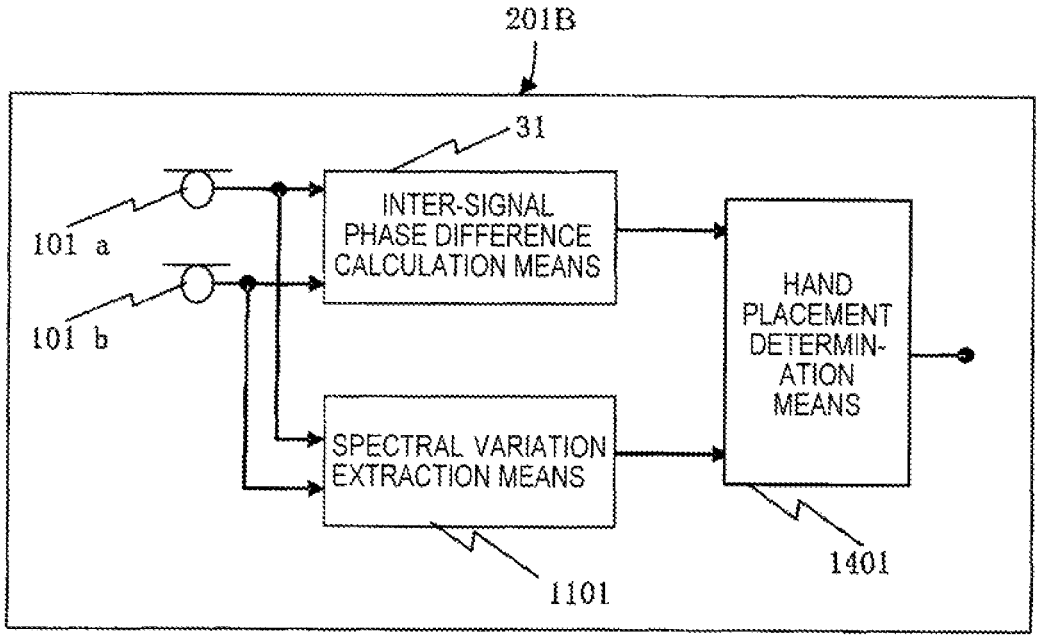
FIG. 16 is a block diagram showing the configuration of hand placement detection means 201B.

The configuration of the hand placement detection means 201B will be described with reference to FIG. 16. FIG. 16 is a block diagram showing the configuration of the hand placement detection means 201B. The hand placement detection means 201B shown in FIG. 16 includes inter-signal phase difference calculation means 31, spectral variation extraction means 1101, and hand placement determination means 1401. The operations of the inter-signal phase difference calculation means 31 and the spectral variation extraction means 1101 are the same as described in the first and second embodiments, thus detailed description thereof will be omitted.

The hand placement determination means 1401 determines that there is a hand placement when both determination conditions are satisfied using both the outputs of the inter-signal phase difference calculation means 31 and the spectral variation extraction means 1101. That is, it is confirmed whether or not the time when the inter-signal time difference obtained by the inter-signal phase difference calculation means 31 is equal to or greater than the threshold value (Cth) continues for equal to or greater than a threshold value (Tth). Only if both determination conditions are satisfied, that is, if it is confirmed that the time equal to or smaller than Cth continues for equal to or greater than Tth, and focusing on a spectral variation from the time t0 to t1 from a spectral variation 1305 of FIG. 13, when the total value of ΔV1*a* and ΔV1*b* is equal to or smaller than the threshold value (Dth1), if the total value of ΔV3*a*, ΔV3*b*, ΔV4*a*, and ΔV4*b* is equal to or greater than the threshold value (Dth2), it is determined that there is a hand placement.

Therefore, according to the hand placement detection device 3 of this embodiment, the presence/absence of a hand placement is determined based on a temporal change in power and a temporal change in the phase difference between signals input from two microphones in the specific frequency bands of the signals input from the two microphones.

According to the hand placement detection device 3 of this embodiment, a configuration is made such that determination is performed by processing the input signals input two microphones, thereby detecting a hand placement without providing an additional sensor. Since an additional sensor is not provided, it is possible to detect a hand placement without causing an increase in the size of the hearing aid.

Although in this embodiment, a hearing aid having two microphones has been described, the invention can also be applied to a hearing aid having three or more microphones.

Fourth Embodiment

Figure 17:
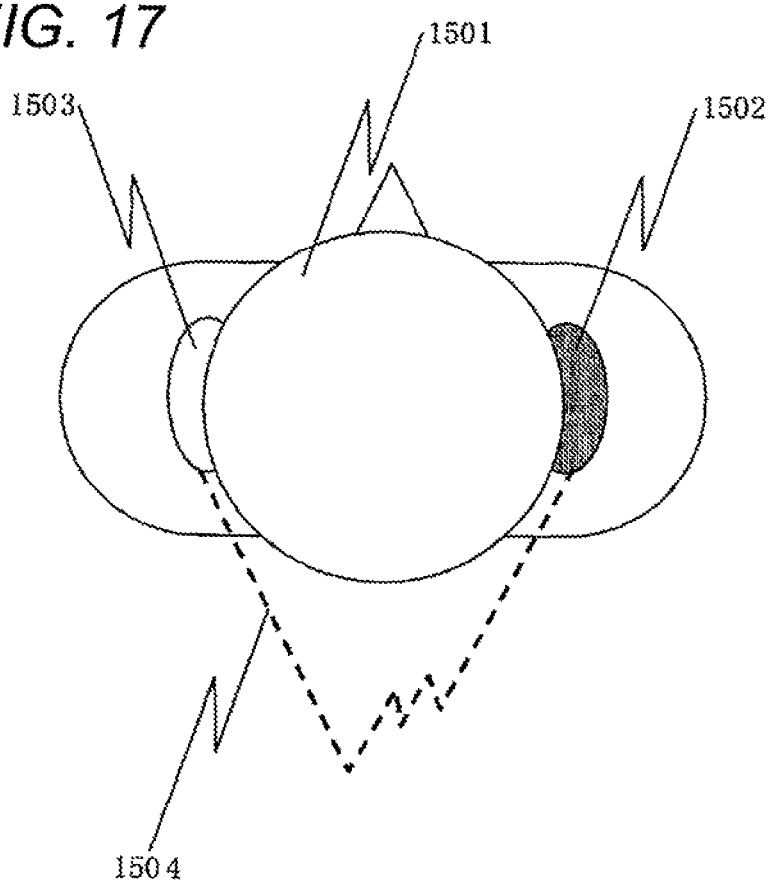
FIG. 17 is a configuration diagram showing a hearing aid device including a hand placement detection device of a fourth embodiment of the invention.
Figure 18:
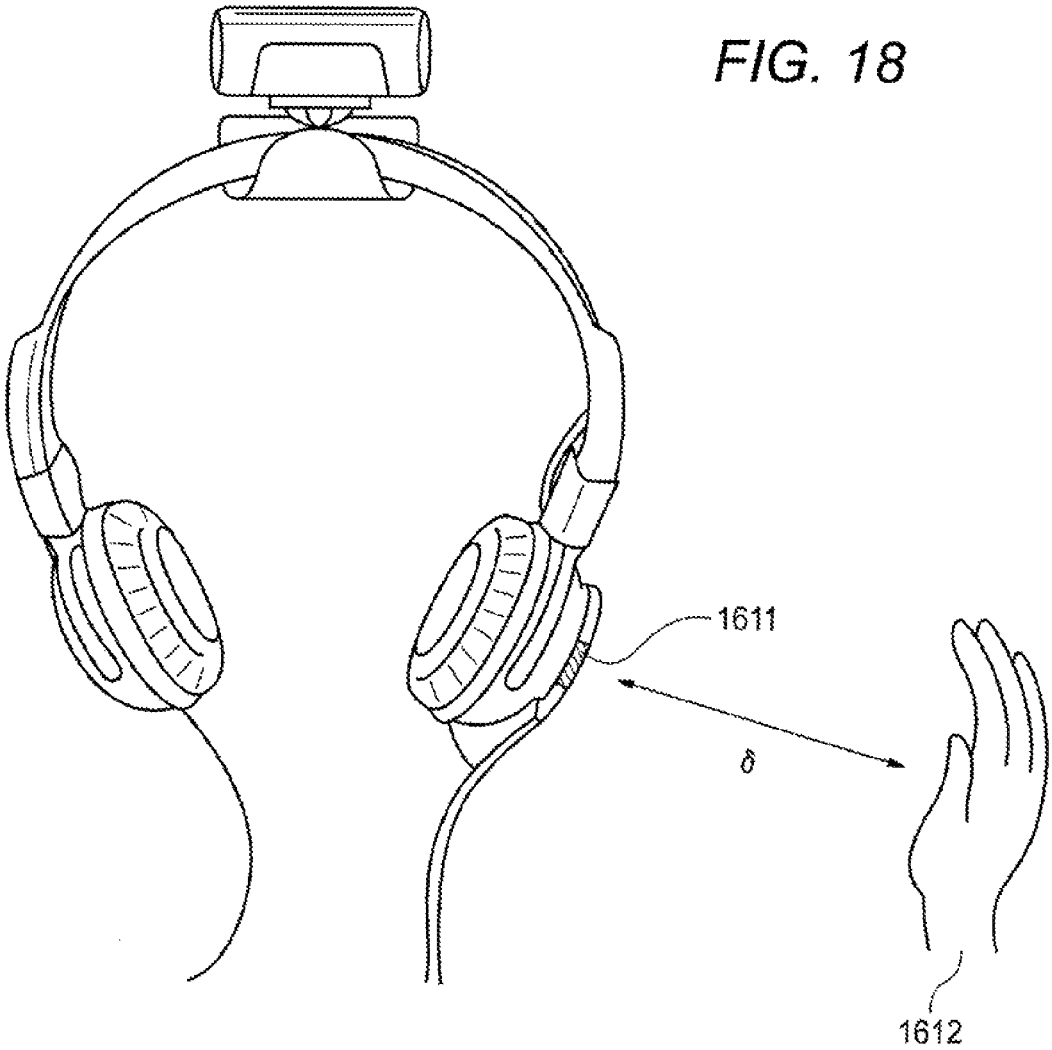
FIG. 18 is a schematic configuration diagram showing a configuration 1600 which realizes a hand placement detection function.
Figure 19:
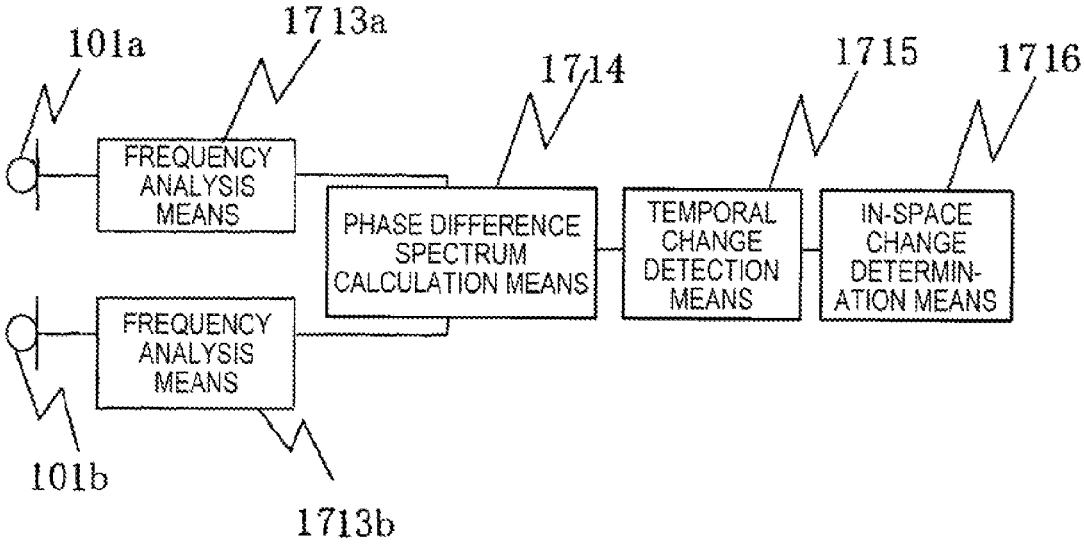
FIG. 19 is a block diagram showing the configuration of a device which detects a temporal change of a phase difference spectral pattern.

FIG. 17 is a configuration diagram of a hand placement detection system having a hand placement detection device according to a fourth embodiment of the invention. A hearing aid device having a hand placement detection device shown in FIG. 17 includes a right-ear in-the-canal hearing aid 1502, a left-ear in-the-canal hearing aid 1503, and a communication means 1504. A user 1501 is fitted with the in-the-canal hearing aid 1502 in the right ear and the in-the-canal hearing aid 1503 in the left ear.

The in-the-canal hearing aid 1502 and the left-ear in-the-canal hearing aid 1503 have the same configuration as the in-the-canal hearing aid 11 having the hand placement detection device 1 described in the first embodiment, except that the communication means 1504 is provided, thus detailed description thereof will be omitted.

The communication means 1504 is wireless communication means which performs wireless communication between the right-ear in-the-canal hearing aid 1502 and the left-ear in-the-canal hearing aid 1503. Here, electromagnetic induction is used.

The in-the-canal hearing aid 1502 and the left-ear in-the-canal hearing aid 1503 can receive a notification indicating hand placement detection from one hearing aid through the communication means 1504 or can transmit a notification indicating hand placement detection to another hearing aid.

For example, in FIG. 17, when the right-ear in-the-canal hearing aid 1502 detects a hand placement, the in-the-canal hearing aid 1502 notifies the left-ear in-the-canal hearing aid 1503 of a hand placement being detected through the communication means 1504. The left-ear in-the-canal hearing aid 1503 which receives the notification indicating hand placement detection maintains the directivity signal process in the current state, and performs control to increase the volume of sound output from the receiver 205. For example, the in-the-canal hearing aid 1503 increases the volume of sound output from the receiver 205 to 1.2 times. The numerical value of the sound volume may be changed in accordance with another index, such as the hearing ability of the user or an ambient noise level.

According to the hearing aid device having the hand placement detection device of the fourth embodiment, a configuration is made such that determination is performed by processing the input signals input two microphones, thereby detecting a hand placement without providing an additional sensor. In a hearing aid device in which both ears are in collaboration with each other, when a hand placement is detected on one side, it becomes possible to change control of the hearing aid for the left and right hearing aid terminals.

Although in this embodiment, a hearing aid terminal having two microphones has been described, the invention can also be applied to a hearing aid having three or more microphones.

The hand placement detection device of each of the first to fourth embodiments detects a hand placement over an ear using input signals input from two or more microphones of the hearing aid. Thus, the hand placement detection device functions as detection means for determining control of the hearing aid.

The hand placement detection device of each of the first to fourth embodiments detects a hand placement over an ear. Therefore, in a hearing aid which has two or more microphones and performs a directivity signal process, it becomes possible to detect a user's hand placement over his/her ear without providing an additional sensor, and to change control.

With regard to the change of control, for example, it is considered that a directivity signal process for taking an input difference stops and becomes nondirective, the forward directivity of input sound is left to reflection by the presence of the placed hand, and an output sound pressure increase after the inputs of a plurality of microphones are added, or the like. Therefore, it becomes possible to change control of the hearing aid so as to match hope "wants to hear forward sound better" which is generally regarded as an intension when the user places his/her hand over his/her ear, without requiring the user to operate a small switch in the hearing aid.

Although the invention has been described in detail or with reference to the specific embodiment, it should be apparent to those skilled in the art that various changes or alterations may be made without departing from the spirit and scope of the invention.

This application is based on Japanese Patent Application No. 2009-108805, filed on Apr. 28, 2009, the content of which is incorporated herein by reference.

INDUSTRIAL APPLICABILITY

The hearing aid device and the hearing aid method of the invention have an advantage capable of controlling a directivity process or an amplification process in a hearing aid with a user's hand placement so as to match a user's intuition, and are useful as a hearing aid.

DESCRIPTION OF REFERENCE SIGNS

101*a*, 101*b*, 1901*a*, 1901*b*: microphone
11: in-the-canal hearing aid main body
12: directivity control mode selector switch
13: volume switch
31: inter-signal phase difference calculation means
32: hand placement determination means
41*a*, 41*b*: band-pass filter means
42*a*: signal subtraction means
42*b*: signal addition means
43*a*, 43*b*: absolute value calculation means
44*a*, 44*b*: smoothing means
45: phase difference level calculation means
51: user of hearing aid
52: right ear of user of hearing aid
53: speaker
201: hand placement detection means
202: hearing aid process control means
203: directivity sound pickup means
204: nonlinear amplification means
205: receiver
701*a*, 701*b*: delay unit
702*a*, 702*b*: variable amplifier
703: adder
704: equalizer
1101: spectral variation extraction means
1102: hand placement determination means
1301: filter processing means
1302: band power calculation processing means
1304: time difference calculation means
1502: right-ear in-the-canal hearing aid
1503: left-ear in-the-canal hearing aid
1504: communication means
1611: infrared distance sensor
1713*a*, 1713*b*: frequency analysis means
1714: phase difference spectrum calculation means
1715: temporal change detection means
1716: in-space change determination means

The invention claimed is:

1. A hearing aid device comprising:

a plurality of microphones configured to convert picked sound to audio signals:

an inter-signal phase difference calculation unit configured to calculate a phase difference between a first audio signal converted by a first microphone of the plurality of microphones and a second audio signal by a second microphone of the plurality of microphones;

a hand placement determination unit configured to determine whether a state where the phase difference is a first threshold value or less continues for a first time;

a directivity sound pickup unit configured to superimpose a sensitivity-frequency characteristic for controlling sensitivity in a sound pickup direction on the first audio signal acquired from the first microphone and the second audio signal acquired from the second microphone to control the frequency characteristics of the audio signals, and to generate an output signal;

a nonlinear amplification unit configured to control a signal level of the output signal acquired from the directivity sound pickup unit; and a hearing aid process control unit configured, when the hand placement determination unit determines that the state where the phase difference is the first threshold value or less continues for the first time, to control the directivity sound pickup unit such that at least one of the sensitivity-frequency characteristic and the frequency characteristics of the audio signals becomes nondirective, and to control the nonlinear amplification unit to amplify signal levels of the acquired audio signals.

2. The hearing aid device according to claim 1, further comprising:

a spectral variation extraction unit configured to divide the first audio signal acquired from the first microphone and the second audio signal acquired from the second microphone into at least two frequency bands of a first frequency band and a second frequency band higher than the first frequency band, and to calculate a first spectral variation of the first audio signal and the second audio signal for a second time in the first frequency band and a second spectral variation of the first audio signal and the second audio signal for the second time in the second frequency band, wherein the hand placement determination unit is configured to determine whether the state where the phase difference is the first threshold value or less continues for the first time, to determine whether the first spectral variation is a second threshold value or less, and to determine whether the second spectral variation is a third threshold value or less, and wherein when the hand placement determination unit determines that the state where the phase difference is the first threshold value or less continues for the first time, determines that the first spectral variation is the second threshold value or less, and determines that the second spectral variation is the third threshold value or less, the hearing aid process control unit controls the directivity sound pickup unit such that at least one of the sensitivity-frequency characteristic and the frequency characteristics of the audio signal becomes nondirective, and controls the nonlinear amplification unit to amplify the signal levels of the acquired audio signals.

3. The hearing aid device according to claim 2, wherein the first frequency band is 800 Hz or less and the second frequency band is 1 kHz to 3 kHz.

4. The hearing aid device according to claim 1, wherein the inter-signal phase difference calculation unit limits frequency bands of the first audio signal and the second audio signal to a third frequency band, and divides an absolute value of a subtraction result of the band-limited first audio signal and the band-limited second audio signal by an absolute value of an addition result of the band-limited first audio signal and the band-limited second audio signal, thereby calculating the phase difference.

5. The hearing aid device according to claim 4, wherein the third frequency band is 1 kHz to 3 kHz.

6. The hearing aid device according to claim 1, wherein, when the hand placement determination unit determines that the state where the phase difference is the first threshold value or less continues for the first time, the hearing aid process control unit controls the directivity sound pickup unit such that at least one of the sensitivity-frequency characteristic and the frequency characteristics of the audio signals becomes nondirective, and controls the nonlinear amplification unit to amplify the signal levels of the acquired audio signals, and subsequently, when the hand placement determination unit determines that the state where the phase difference is the first threshold value or less does not continue for the first time, the hearing aid process control unit performs control to return at least one of the sensitivity-frequency characteristic and the frequency characteristics of the audio signals controlled nondirectively to a normal state.

7. A hearing aid method for a hearing aid device that comprises a plurality of microphones configured to convert picked sound to audio signals, said method comprising:

calculating, at an inter-signal phase difference calculation unit, a phase difference between a first audio signal converted by a first microphone of the plurality of microphones and a second audio signal converted by a second microphone of the plurality of microphones;

determining, at a hand placement determination unit, whether a state where the phase difference is a first threshold value or less continues for a first time;

superimposing, at a directivity sound pickup unit, a sensitivity-frequency characteristic for controlling sensitivity in a sound pickup direction on the first audio signal acquired from the first microphone and the second audio signal acquired from the second microphone to control the frequency characteristics of the audio signals, and generating an output signal;

controlling, at a nonlinear amplification unit, a signal level of the output signal acquired from the directivity sound pickup unit; and controlling, at a hearing aid process control unit, the directivity sound pickup unit such that at least one of the sensitivity-frequency characteristic and the frequency characteristics of the audio signals becomes nondirective, and controlling the nonlinear amplification unit to amplify the signal levels of the acquired audio signals, when the hand placement determination unit determines that the state where the phase difference is the first threshold value or less continues for the first time.

8. A hearing aid method for a hearing aid device that comprises a plurality of microphones configured to convert picked sound to audio signals, said method comprising:

calculating, at an inter-signal phase difference calculation unit, a phase difference between a first audio signal converted by a first microphone of the plurality of microphones and a second audio signal converted by a second microphone of the plurality of microphones;

dividing, a spectral variation extraction unit, the first audio signal and the second audio signal into two frequency bands of a first frequency band and a second frequency band higher than the first frequency band, and calculating a first spectral variation of the first audio signal and the second audio signal for a first time in the first frequency band and a second spectral variation of the first audio signal and the second audio signal for the first time in the second frequency band;

determining, at a hand placement determination unit, whether a state where the phase difference is a first threshold value or less continues for a second time, determining whether the first spectral variation is a second threshold value or less, and determining whether the second spectral variation is a third threshold value or less;

superimposing, at a directivity sound pickup unit, a sensitivity-frequency characteristic for controlling sensitivity in a sound pickup direction on the first audio signal acquired from the first microphone and the second audio signal acquired from the second microphone to control the frequency characteristics of the audio signals, and generating an output signal;

controlling, at a nonlinear amplification unit, the signal level of the output signal acquired from the directivity sound pickup unit; and controlling, at a hearing aid process control unit, the directivity sound pickup unit such that at least one of the sensitivity-frequency characteristic and the frequency characteristics of the audio signals becomes nondirective, controlling the nonlinear amplification unit to amplify the signal levels of the acquired audio signals, when the hand placement determination unit determines that the state where the phase difference is the first threshold value or less continues for the second time, determines that the first spectral variation is the second threshold value or less, and determines that the second spectral variation is the third threshold value or less.

* * * * *